US006234318B1

(12) United States Patent
Breau et al.

(10) Patent No.: US 6,234,318 B1
(45) Date of Patent: May 22, 2001

(54) FLOTATION AND CYANIDATION PROCESS CONTROL

(75) Inventors: Yves Breau, Malartic; Martin DeMontigny, Evain; Eric Levesque, Malartic; Jacques McMullen, Toronto; Dany Pelletier, Montréal; Pierre Pelletier, Malartic, all of (CA)

(73) Assignee: Barrick Gold Corporation, Toronto (CA)

( * ) Notice: Subject to any disclaimer, the term of this patent is extended or adjusted under 35 U.S.C. 154(b) by 0 days.

(21) Appl. No.: 09/305,787

(22) Filed: May 4, 1999

(51) Int. Cl.[7] ..... B03D 1/02; B03B 7/00; B03B 13/00

(52) U.S. Cl. ..... 209/164; 209/166; 423/29

(58) Field of Search ..... 209/166, 1, 164, 209/167; 423/26, 29, 30, 31

(56) References Cited

U.S. PATENT DOCUMENTS

| | | | |
|---|---|---|---|
| 3,189,435 * | 6/1965 | Lower . | |
| 3,551,897 | 12/1970 | Cooper . | |
| 4,797,550 | 1/1989 | Nelson et al. . | |
| 4,992,942 | 2/1991 | Bauerle et al. . | |
| 5,011,595 | 4/1991 | Meenan et al. | 209/166 |
| 5,082,554 | 1/1992 | Bush et al. | 209/166 |
| 5,232,581 | 8/1993 | Roberts et al. | 209/166 |
| 5,480,562 | 1/1996 | Lemelson . | |
| 5,491,344 | 2/1996 | Kenny et al. . | |

FOREIGN PATENT DOCUMENTS

WO 97/45203 12/1997 (WO) .

OTHER PUBLICATIONS

Bazin et al., Tuning Flotation Circuit Operation As A Function of Metal Prices, Jan. 23–25, 1997, pp. 1–17.

Abstract of DE 3319922A filed Dec. 6, 1984 entitled Chemical Process Regulating System; B. Koglin et al.

* cited by examiner

*Primary Examiner*—Thomas M. Lithgow
(74) *Attorney, Agent, or Firm*—Senniger, Powers, Leavitt & Roedel

(57) ABSTRACT

A method for controlling a froth flotation system in a mineral processing operation for recovering metal from a metal source. A rule-based expert system adjusts performance of the froth flotation system.

27 Claims, 8 Drawing Sheets

FLOTATION AND CYANIDATION PROCESS CONTROL

BACKGROUND OF THE INVENTION

This invention relates to a method for controlling operating parameters in a precious metal recovery operation involving froth flotation and optionally cyanidation.

Froth flotation is widely used for recovering mineral value. It generally involves the use of gas injection including, for example, air, through a slurry that contains water, minerals and gangue particles within a vessel. Minerals are separated from gangue particles by taking advantage of their differences in hydrophobicity. These differences can occur naturally, or can be controlled by the addition of a collector reagent in conjunction with pH control.

Mineral separation using froth flotation is typically achieved via several flotation stages, defined as rougher stage, scavenger stage and cleaners stage. During these several stages, the economical product grade, called concentrate grade, is gradually improved to eventually yield a concentrate of acceptable grade to be sold to a smelter. Each flotation stage produces tails, a secondary product that, for intermediate stages, is frequently recirculated back to the flotation step behind. This recirculating configuration is called a closed circuit flotation configuration. The final tails in a closed circuit process are the scavenger tails. In an open circuit process, some cleaner tails are commingled with the final scavenger tails. Mineral recovery and concentrate grade are important factors in the operation of a successful froth flotation plant.

It has been the practice in froth flotation operations to utilize rather fixed targets for concentrate grade and mineral recovery. Those targets are usually based on flotation performance characterization, ore composition, experience and economical criteria. The fixed targets typically represent an operating range for the flotation circuit, but do not necessarily reflect the best economical performance of the plant in a real-time fashion if the characteristics of the specific minerals being floated are not taken into account.

Heretofore the concentrate grade and mineral recovery targets have not necessarily been variable or accounted for real-time occurring mineralogy, refractory ores occurrences, head grade variation and metal prices. Prior processes have used a net smelter return (NSR) generated from the concentrate grade, metal recovery, flotation reagent costs and other economical parameters to monitor performance. Net smelter return has been implemented through a strategy that includes theoretical grade-recovery curves or other types of metallurgical models. Such models usually have fixed parameters which do not present significant adaptability and flexibility. Consequently, such models do not provide real-time control in relation to the several variables mentioned above. One such prior proposal was disclosed by Bazin et al., "Tuning Flotation Circuit Operation as a Function of Metal Prices," *Conf. Mineral Proc.* 1997.

Cyanidation is sometimes employed in conjunction with flotation to recover gold values from flotation tails. Tails are contacted with cyanide in a series of agitated tanks to dissolve gold particles, producing a solid phase having a minimum gold content and a liquid phase having a maximum gold content. The gold is then recoverable by conventional means, such as the Merrill-Crowe process or others.

During cyanidation, minerals known as cyanicide minerals release into solution other elements including arsenic, iron, copper, sulphur and others along with gold. Copper solubilization, for example, can range from about 5% with chalcopyrite to about 95% with azurite. Cyanicide minerals are problematic because they consume cyanide, thus increasing reagent costs. Copper, for example, consumes 2 to 4 moles cyanide per mole copper, thus increasing costs by up to as much as several dollars per tonne of ore treated. High cyanide consumption also requires expensive detoxification of the final leached plant residues.

As two or more copper minerals and other cyanicide minerals are present in an ore body, processing becomes more complex. The complexity arises from the fact that cyanide consumption varies widely and cyanide demand for adequate gold recovery varies widely. Furthermore, detoxification reagent consumption varies widely. Where demand for cyanide and detoxification reagents are great, or vary greatly, optimum economical operation does not necessarily correspond to optimum metallurgical performance in terms of metal recovery.

SUMMARY OF THE INVENTION

It is an object of the invention, therefore, to provide a process for controlling a metal recovery operation, more particularly a gold recovery operation having a flotation circuit, in such a way that accounts for varying mineralogy, reagent costs and other variables to enhance overall economic performance of the operation. It is also an object to provide such a process where the operation involves integrated flotation and cyanidation circuits.

Briefly, therefore, the invention is directed to a method for controlling a froth flotation system in a mineral processing operation. The method involves determining a target value for the amount of metal to be recovered by the froth flotation, determining a probability factor related to the probability of achieving the target value on the basis of historical and diagnostic knowledge of the froth flotation system, and controlling the froth flotation system by a rule-based expert system which adjusts performance of the froth flotation system in part on the basis of the probability factor.

The invention is also directed to a method for controlling a froth flotation system wherein the probability factor is determined in part on the basis a determination of circuit status of underloading, balanced, or overloaded.

The invention is further directed to the foregoing method involving a determination of circuit status, wherein the rule based system employs a set of primary cause rules to select a parameter of the flotation to be adjusted, and a set of secondary cause rules to evaluate whether there is margin for adjustment of the selected parameter.

The invention is also directed to a method for controlling a froth flotation system which involves determining data corresponding to costs associated with smelting and refining metal values in the flotation concentrate, determining data corresponding to costs associated with a secondary metal recovery operation performed on tails from the flotation, determining data corresponding to revenue from metal values in the flotation concentrate, and/or determining data corresponding to revenue from metal values in the tails, and controlling the froth flotation system by a rule-based expert system which adjusts performance of the froth flotation system in part on the basis of one or more of the foregoing data.

In another aspect the invention is directed to a method for controlling a froth flotation system involving determining metal revenue data corresponding to metal revenues from recovered metal values associated with a secondary recovery operation performed on tails from the flotation, determining reagent data corresponding to reagent costs associated with the secondary recovery operation, determining operating profit data corresponding to operating profit of the mineral processing operation as a function of the metal revenue data and the reagent data, and controlling the froth flotation system by a rule-based expert system which adjusts performance of the froth flotation system in part on the basis of the operating profit data.

The invention is also directed to a method for controlling a froth flotation system involving determining data corresponding to costs associated with a secondary metal recovery operation performed on tails from the flotation, determining data corresponding to revenue from metal values in the tails, and controlling the froth flotation system by a rule-based expert system which adjusts performance of the froth flotation system in part on the basis of the foregoing data.

The invention is further directed to a method for controlling a froth flotation system by a rule-based expert system which adjusts performance of the froth flotation system in part on the basis of data which corresponds to a determination selected from the group consisting of a determination of costs associated with the secondary metal recovery operation, a determination of costs associated with the froth flotation system, a determination of costs associated with smelting and refining metal values in the flotation concentrate, a determination of revenue from metal values in said flotation concentrate, and a determination of revenue from metal values in said tails. Under some conditions, the expert system decreases metallurgical performance of the froth flotation system in order to increase economic performance of the mineral processing operation.

In another aspect the invention is directed to a method for controlling a froth flotation system which method involves determining detoxification reagent data corresponding to reagent costs associated with detoxification of effluent from a secondary metal recovery operation performed on tails from the flotation operation, and controlling the froth flotation system by a rule-based expert system which adjusts performance of the froth flotation system in part on the basis of the detoxification data.

The invention is also directed to a method for controlling a froth flotation system by determining a set of values to remain constant which relate to mineralogical characteristics of feed material to the froth flotation system, to leaching reagent consumption in said secondary recovery operation, and to detoxification reagent consumption in said detoxification operation. The method also involves determining by chemical analysis on a real-time basis the amount of recoverable metal values in flotation tails, and controlling the froth flotation system by a rule-based expert system which adjusts performance of the froth flotation system in part on the basis of the constant values, in part on the basis of the chemical analysis, and in part on the basis of a determination of operating profit of the mineral processing operation as a function of metal revenues from a secondary recovery operation performed on flotation tails and reagent costs associated with the secondary metal recovery operation.

The invention is also directed to an apparatus for controlling a froth flotation system in a mineral processing operation. The apparatus has a froth flotation circuit, a cyanidation circuit, flotation circuit sensors for monitoring operation of the flotation circuit, cyanidation circuit sensors, and a flotation circuit controller. The controller is responsive to signals received from the cyanidation circuit sensors and controls the flotation circuit on the basis of data which corresponds to at least two determinations selected from the group consisting of a determination of costs associated with the froth flotation system, a determination of costs associated with smelting and refining metal values in the flotation concentrate, a determination of costs associated with said secondary metal recovery operation, a determination of revenue from metal values in said flotation concentrate, and a determination of revenue from metal values tails.

Other objects and features will be in part apparent and in part pointed out hereinbelow.

DETAILED DESCRIPTION OF THE INVENTION

Figure 1A:
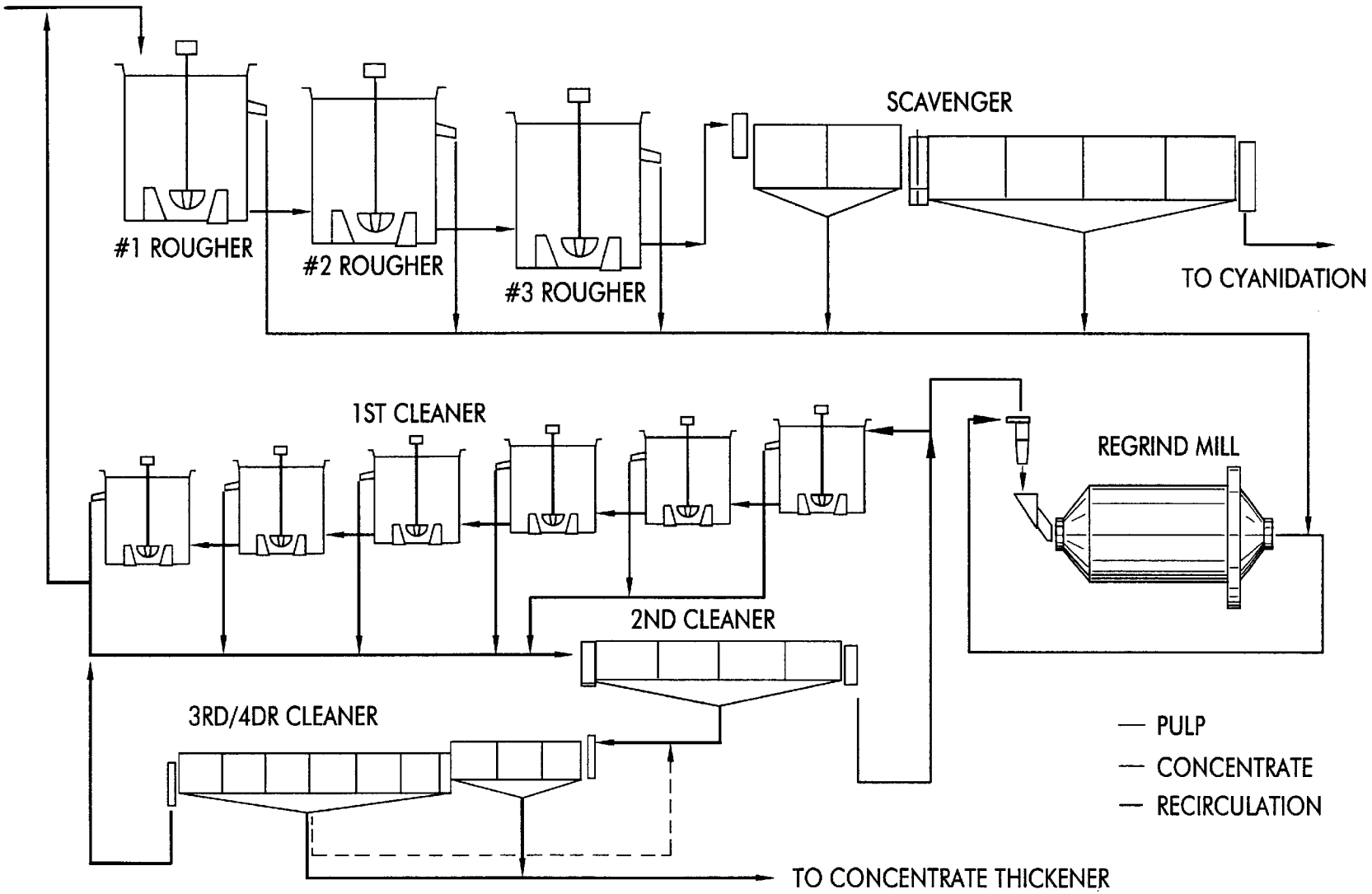
FIGS. 1A and 1B are a schematic representations of a flotation circuit and cyanidation circuit of the type to which the invention applies.
Figure 1B:
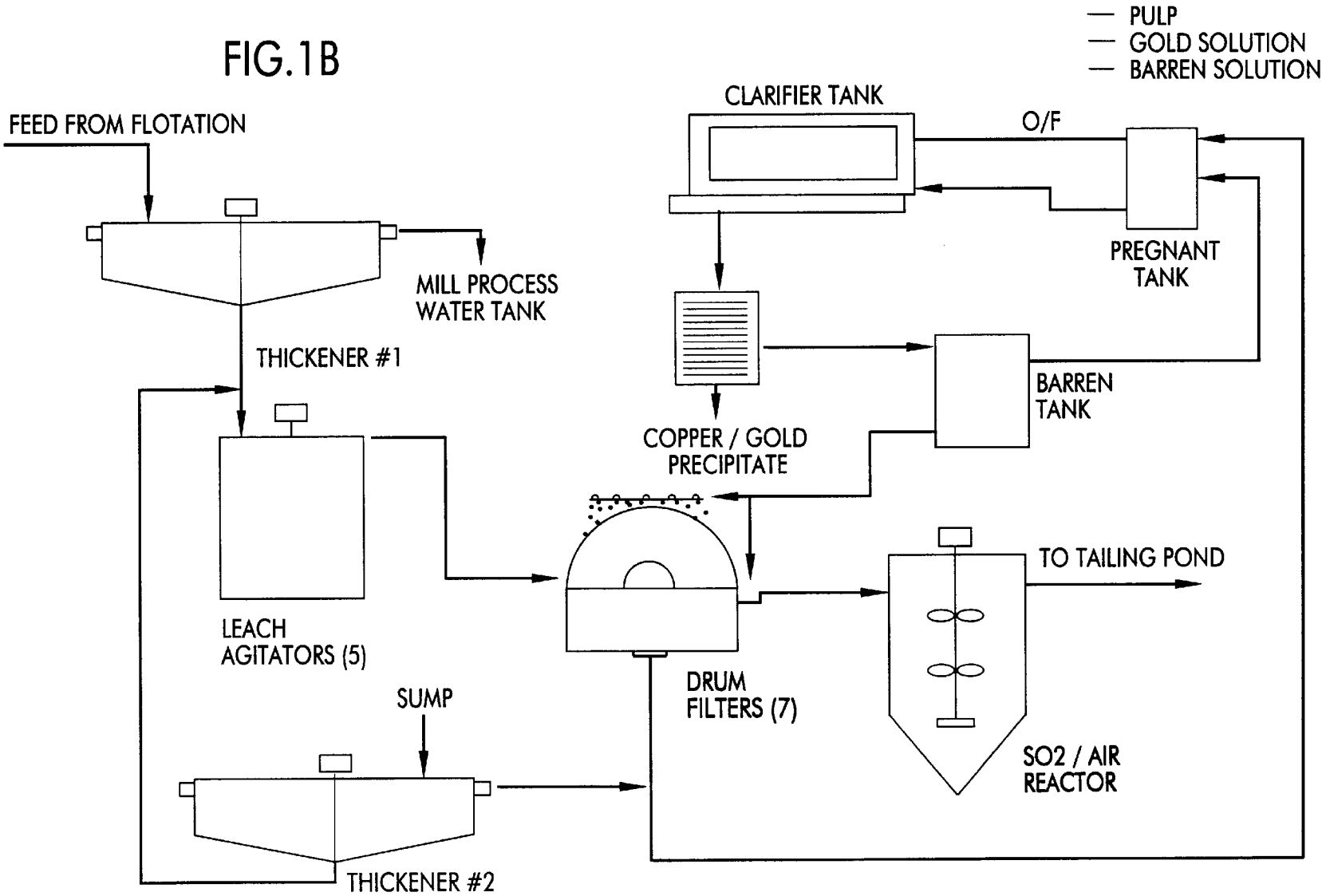
Figure 2:
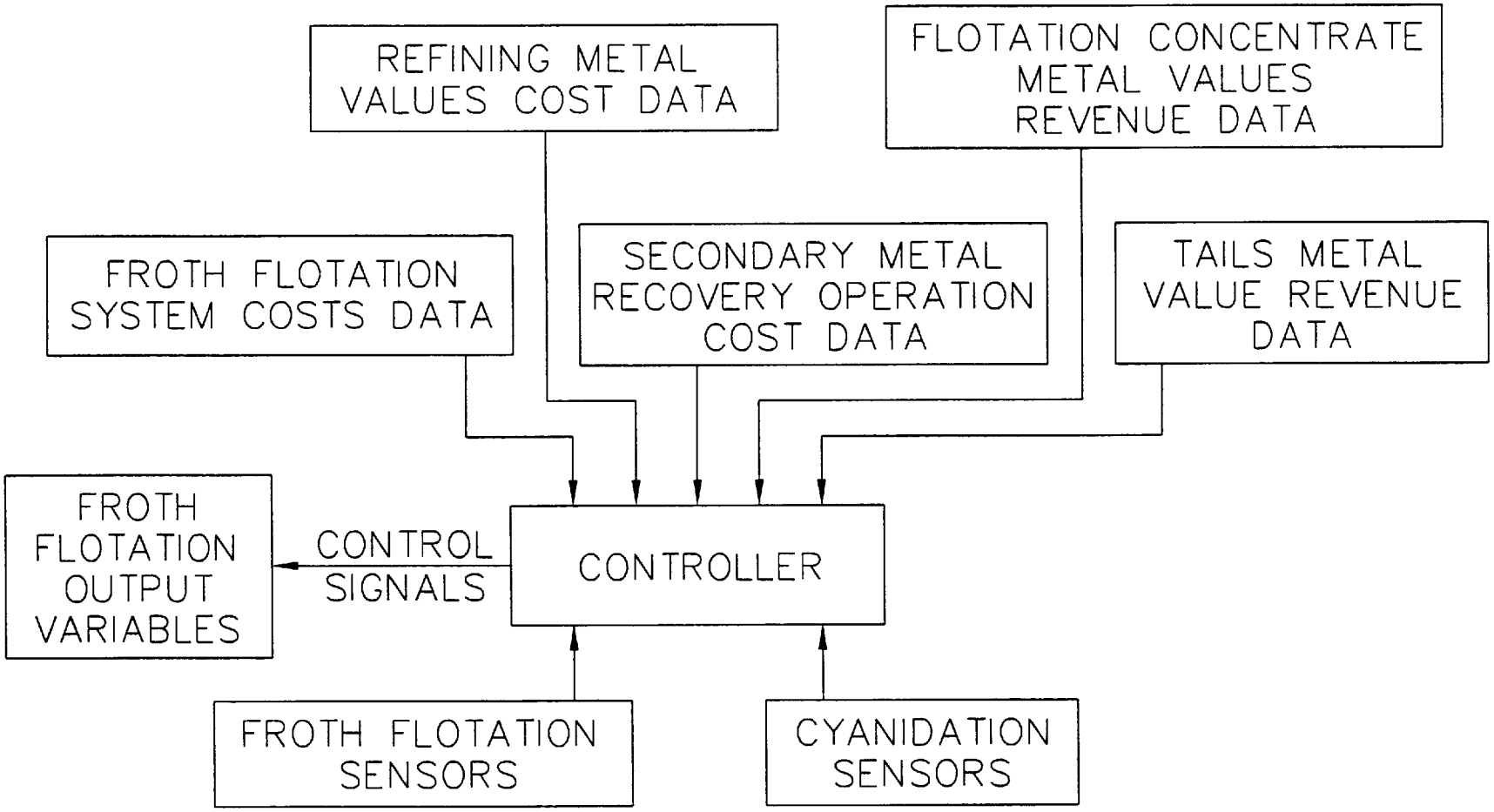
FIG. 2 is functional block diagram of the flotation system controller of the invention.

The present invention firstly relates to process control where there are integrated flotation and cyanidation operations, and secondly relates to a process control methodology for a flotation system regardless of whether there is an integrated cyanidation operation. In the first aspect, the invention provides an approach to processing gold-copper ores involving on-line control of total economical value of integrated flotation and cyanidation processes by the use of a combined economical value. FIGS. 1 and 2 illustrate flotation and cyanidation circuits to which the invention applies. By developing an economical link between cyanidation and flotation, the invention facilitates determination of operating parameters, such as to increase concentrate grade to the detriment of copper recovery, or conversely to decrease concentrate grade to the enhancement of copper recovery, to enhance overall economic performance, and to optimize economic return on a real-time basis. The present invention provides an approach for improving real-time economical optimum that takes into account, for example, the mineralogy variation and several other real-time fluctuating variables that cannot be integrated into a theoretical metallurgical model.

In the second aspect the invention involves a control definition methodology to facilitate control and optimization of the flotation circuit within a wide band of operation. The integration of circulating load criteria, circuit diagnostic information, probability factors, fluctuating internal process objectives such as a variable mineral concentrate grade, and a range of recovery targets into the flotation control improves performance of the flotation circuit on a real-time basis. According to this invention, an operating profit equation is employed that includes net smelter return (metal prices, smelter charges), reagent consumption and its possible interrelation with other linked processes. General flotation circuit status is evaluated through on-line metallurgical performance, pump box level, pump speed, and pulp flow rates at different areas within the circuit.

Based on circuit status (or circuit loading), the invention involves evaluation of circuit stability and a load level at which the flotation circuit is being operated. From this evaluation, three situations can occur. First, the circuit can be underloaded and it is therefore determined that there is room for improvement. Second, the circuit can be overloaded such that it is impossible to maintain the actual performance level and it is therefore required to sacrifice one of the operation objectives. Third, the circuit can be well balanced, such that actual performance level is close to circuit optimum.

Using the above circuit loading evaluation and through the use of a process economic equation often equivalent to the net smelter return, the system provides targets in terms of concentrate grade or recovery that should be taken for optimum overall plant economic performance.

Once a direction has been chosen and implemented, the invention involves review and adjustment of flotation circuit internal conditions. While most specific actions can be implemented automatically by the expert system of the invention, in the event that an action cannot be automatically actuated by the expert system itself, the operator is paged via phone by the expert system and advised of a specific manual task that should be performed.

In achieving its overall objectives, one function of the invention is to provide operators with concentrate grade and recovery targets that represent the optimum economical value that can be achieved at a specific moment for the overall plant rather than just for the flotation process on an isolated basis. Significantly, flotation targets do not necessarily represent the maximized metallurgical performance of the flotation circuit but rather are integrated with other plant data to improve overall plant performance. Other variables to be integrated, for example, relate to mineralogical species being processed, head grade, metal output, metal prices, reagent costs, smelter costs and the like.

A further function of the invention is to provide to the operators internal flotation circuit targets that take into account process variable changes such as mineralogy and head grade. This allows a higher degree of flexibility within the circuit operation enabling an enhanced economical optimum.

It is also a function of the invention to integrate into the operation use of a process economic equation or alternatively a net smelter return equation and a circuit loading evaluation. This provides the operation with a unique way of obtaining the best overall operation criteria independently of the individual operating the flotation circuit. In other words, it is another function of this invention to facilitate operation with a higher degree of performance resulting from consolidation and standardization of the operation methodology.

In carrying out the invention, a computer system gathers information from sensors which monitor various froth flotation circuit parameters and cyanidation circuit parameters on a real-time basis from the operation field. Data collected on a real-time basis as well as set point data are used through the control algorithms to produce a set of output variables which control the flotation operation. As can be seen in FIG. 2, a controller receives data relating to froth flotation system costs, metal value smelting and refining costs, secondary metal recovery (i.e., cyanidation) costs, flotation concentrate metal value revenues, and tails metal value revenues. The controller also receives data from froth flotation and cyanidation sensors. Upon processing these data, output from the controller includes froth flotation output variables for controlling this operation.

Examples of Specific Input and Output Variables are as Follows:

Input Variables (Process variables)

Rod mill motor amperage

5 Rod mill feed tonnage

Flotation feed percent solid

Regrind mill discharge pump speed

First cleaner feed pump speed

Rougher concentrate pump box high level to Scavenger concentrate pump box high level Second cleaner feed pump box high level Second cleaner pH controller valve output Third cleaner pH controller valve output First rougher air flowrate Second rougher air flowrate Third rougher air flowrate First cleaner tails volumetric flowrate Rougher concentrate volumetric flowrate First cleaner first cell air flowrate First cleaner second cell air flowrate First cleaner third cell air flowrate First cleaner fourth cell air flowrate First cleaner fifth cell air flowrate First cleaner sixth cell air flowrate Final tails copper grade Rougher feed copper grade Rougher tails copper grade First cleaner tails copper grade Scavenger concentrate copper grade First cleaner scavenger concentrate copper grade Rougher concentrate copper grade Second cleaner feed copper grade Final concentrate copper grade Second cleaner feed pH value Third cleaner feed pH value First cleaner first cell concentrate by pass First cleaner second cell concentrate by pass Third cleaner number of cells to final concentrate Third cleaner flowsheet configuration Rougher feed copper unit flowrate First cleaner tails circulating load Input Variables (set points)

Rod mill feed tonnage

First rougher air flowrate

Second rougher air flowrate

Third rougher air flowrate

First cleaner, first cell air flowrate

First cleaner second cell air flowrate

First cleaner third cell air flowrate

First cleaner fourth cell air flowrate

First cleaner fifth cell air flowrate

First cleaner sixth cell air flowrate

Second cleaner pH value

Third cleaner pH value

First rougher frother addition rate

Output Variables

First rougher air flowrate set point

Second rougher air flowrate set point

Third rougher air flowrate set point

First cleaner, first cell air flowrate set point

First cleaner second cell air flowrate set point

First cleaner third cell air flowrate set point

First cleaner fourth cell air flowrate set point

First cleaner fifth cell air flowrate set point

First cleaner sixth cell air flowrate set point

Manual action request for first cleaner first cell by pass

Manual action request for first cleaner second cell by pass

Manual action request for scavenger operation verification

Manual action request for second and third cleaners operation verification

Manual action request for third cleaner number of cells to final concentrate

Manual action request for third cleaner flowsheet configuration

Second cleaner pH set point

Third cleaner pH set point

Frother addition set point

Operating Profit

In a continuous mode, the system calculates the overall process economical value on a real-time basis. The economical value is represented by the following equation:

$$\text{Operating Profit (OP)}=NSR_{flotation}+NR_{leach}$$

OP units are used in terms of net profit dollars per tonne of ore treated. Such OP evaluation is always carried out with two additional net smelter value evaluations. One defines the OP value using a hypothetical concentrate grade improvement of 2% while flotation tails are kept constant. The second calculation provides an OP evaluation based on a flotation tails grade reduction of 0.02% while the flotation concentrate grade is kept constant. Those hypothetical scenarios provide basic economical cases that should be used to define the best optimization direction.

OP improvement values are then compared and reconciled with existing circuit concentrate grade and tails grade values. The process adjustment correction rate is selected in using probability factors (PF). The expert system controls the flotation system in part on the basis of operating profit data which are adjusted by such probability factors. Those factors, based on previous process performance, rely on the probability of achieving a better concentrate grade or a better tails grade without sacrificing the other parameter which should remain constant.

The probability factor equations are:

$$\text{OPC (concentrate grade+2\%)}=OP+(OP_{C+2\%}-OP)*PF_{conc.}$$

$$\text{OPC (tails grade−0.02\%)}=OP+(OP_{t-0.02\%}-OP)*PF_{tails}$$

Probability factors relate to ore body mineralogy factors and are determined by historical knowledge of the circuit performance. Depending on the copper minerals that are being treated, concentrate grade theoretically achievable can vary from 35% for chalcopyrite ($CuFeS_2$) to 80% for chalcocite ($Cu_2S$). These theoretical grades are never obtained through flotation because of factors such as the particle grain size of copper minerals, the broad range of the particle size produced by grinding circuits, the presence of other minerals acting as contaminants such as pyrite (iron mineral), sphalerite (zinc mineral), and others, and flotation inefficiency factors (entrainment, surface contamination, etc.). Each ore body has its own characteristics and the importance of the preceeding factors varies accordingly. Moreover, variations may also occur within the same ore body from zone to zone. The probability factor for concentrate from Bousquet 2, for example, would be much lower at 25% copper concentrate grade compared to the factor value at 18%. This means that increasing concentrate grade by 2% should be easier if the actual value is at 18% compared to 25%.

The use of probability factors eliminates artificial and theoretical targets that would mostly be unachievable. Furthermore, providing unrealistic targets creates undesirable process perturbations. Operating profit values corrected by the probability factors provide the necessary tool for circuit evaluation and economical optimization orientation. It can be seen, therefore, that the invention involves determining a target value for the amount of metal to be recovered by the froth flotation system, i.e., directed to the flotation concentrate metal portion, determining a probability factor related to the probability of achieving the target value on the basis of historical and diagnostic knowledge of the froth flotation system, and adjusting performance of the froth flotation system via the expert system in part on the basis of the probability factor.

A formal step of the optimization sequence which is performed prior to the optimization evaluation relates to an assessment, by the expert system, of the quality of both flotation products or any other fundamental process criteria which directly affect the process stability interpretation. It verifies that unacceptable high flotation tails or low concentrate grades are not occurring. Unacceptable values are based on statistically 97.5% range intervals and are rarely triggered. Basically, they serve as quality control algorithm and, if present, highlight that a critical problem is being encountered which in all likelihood lies outside the knowledge base.

Circuit Evaluations

The expert system evaluates the best alternative between OPC (concentrate+2%) and OPC (tails−0.02%). The following evaluations are provided by circulating load or circuit loading evaluations. In other words, the expert system performs a diagnosis of current prevailing circuit conditions. Three situations can occur. First, the circuit could be underloaded providing a window for improving or optimizing based on the best OPC alternative. Second, the circuit could be overloaded which does require sacrificing one of the process objectives. This means that present target could not be maintained continuously without exceeding circuit capacity. Based on OPC values, the system will provide a defined orientation towards which performance reduction has a lesser impact on overall plant economical performance. Thirdly, the circuit is well balanced and the present economical values should be maintained. It can be seen, therefore, that the rule-based expert system adjusts performance of the flotation system in part on the basis of a determination whether the circuit status corresponds to conditions of underloading where the amount of material passing through the system is below a predetermined minimum, conditions of overloading where the amount of material passing through the system is above a predetermined maximum, or balanced conditions where the amount of metal passing through the system is between the predetermined minimum and the predetermined maximum.

When an orientation improvement or reduction is obtained, the system analyzes the internal status of the flotation circuit. This is determined by intermediate concentrate grade such as cleaners concentrate grade, air flow rate, pH value and so on. Circuit status evaluation allows the system to manipulate automatically or manually with the help of the operator the best variable by which the preferred orientation should be obtained. After a determined period of time (process response transit lag), the results of any change are evaluated in terms of success or failure. Depending on the evaluation, other variables can be manipulated or an additional change can be attributed to the same variable. After the implementation of the entire optimization loop (best OP evaluation, circuit charge estimation and best variable to manipulate) has been completed, the overall process evaluation is repeated.

Secondary Metal Recovery Operation

As discussed above, from a theoretical perspective, a processing flow sheet would direct that the flotation process be maximized, that is, used to recover the payable metal values contained in the ore, which are primarily gold and copper. Mineralogical association does not, however, facilitate such a simplified flow sheet because all the recoverable gold does not report to the flotation concentrate. There are therefore recoverable gold units remaining in the flotation tails which cannot be economically recovered via flotation. As a result, flotation tails are cyanide leached to recover the remaining gold.

In this cyanide leaching operation performed on the flotation tails, the occurrence of cyanide leachable copper, referred to as a cyanicide, in the tails has a significant impact on the operational costs of the cyanide leach circuit. To minimize cyanide consumption, one key variable relates to minimizing the amount of cyanicides, such as cyanide leachable copper, in the flotation tails. Another key variable relates to the mineralogical form of cyanicides in the tails. For example, a given quantity of copper in the form of bornite in flotation tails will consume much more cyanide than the same quantity of copper in the form of chalcopyrite. An indirect mineral occurrence identification method has been developed to evaluate this mineralogical variable on a real time basis.

An understanding of the relationship between copper, copper mineralogy, and recovery of gold by cyanidation is gleaned from examination of the situation at Barrick Est Malartic division. This division receives ore from Bousquet 2 mine, which represents a massive sulfide ore body that contains significant gold value (from 5 to 40 g/t). In addition to its gold content, the Bousquet 2 ore body shows a variable amount of copper from level to level within the mine, from trace to 2% Cu. Copper occurs primarily as bornite and chalcopyrite minerals. Cyanide soluble copper in Bousquet 2 ore presents a significant challenge in processing this type of ore.

Figure 3:
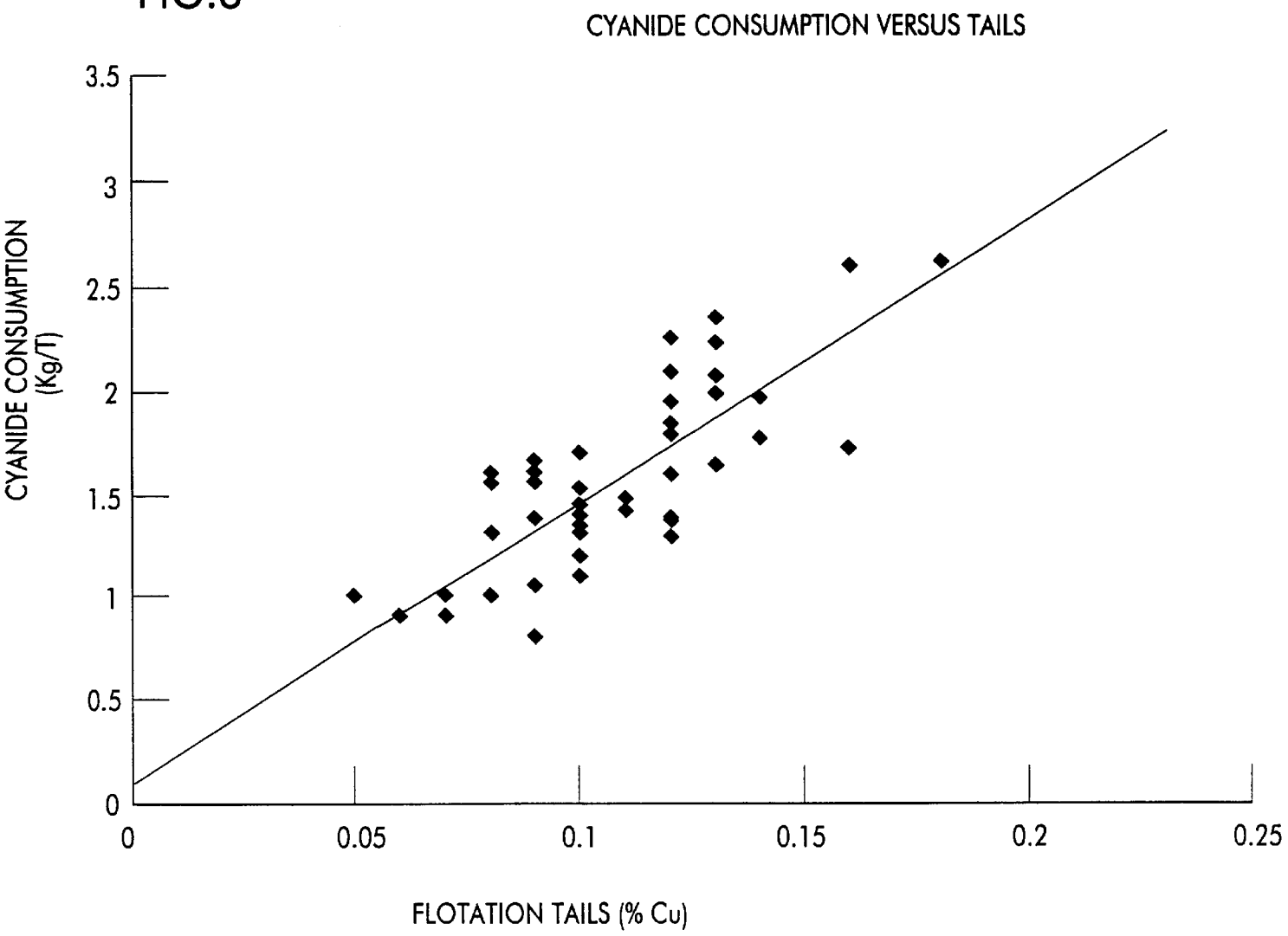
FIG. 3 is a graph illustrating a relationship between cyanide consumption and flotation tails copper concentration.

Because of its high solubility in cyanide, bornite is the predominant cyanide consumer. As such, it would not be economically feasible to conduct cyanidation without having a flotation circuit ahead. This explains, for the Bousquet case, why the economic performance of the flotation operation is tied to the cyanidation process. Losing flotation recovery is a matter of losing copper to the flotation residue and its associated economical value, and also a matter of increased consumption of cyanide, which is an expensive reagent. FIG. 3 illustrates there is an easily discernable relationship between flotation tails grade and cyanide consumption. Dispersion around the trend is explained by the fact that copper minerals can vary from mainly chalcopyrite to mainly bornite. This results in variable copper solubilization with cyanide, as copper solubilization is 70% with bornite but only 6% with chalcopyrite. High copper solubilization corresponds to high cyanide consumption.

Figure 4:
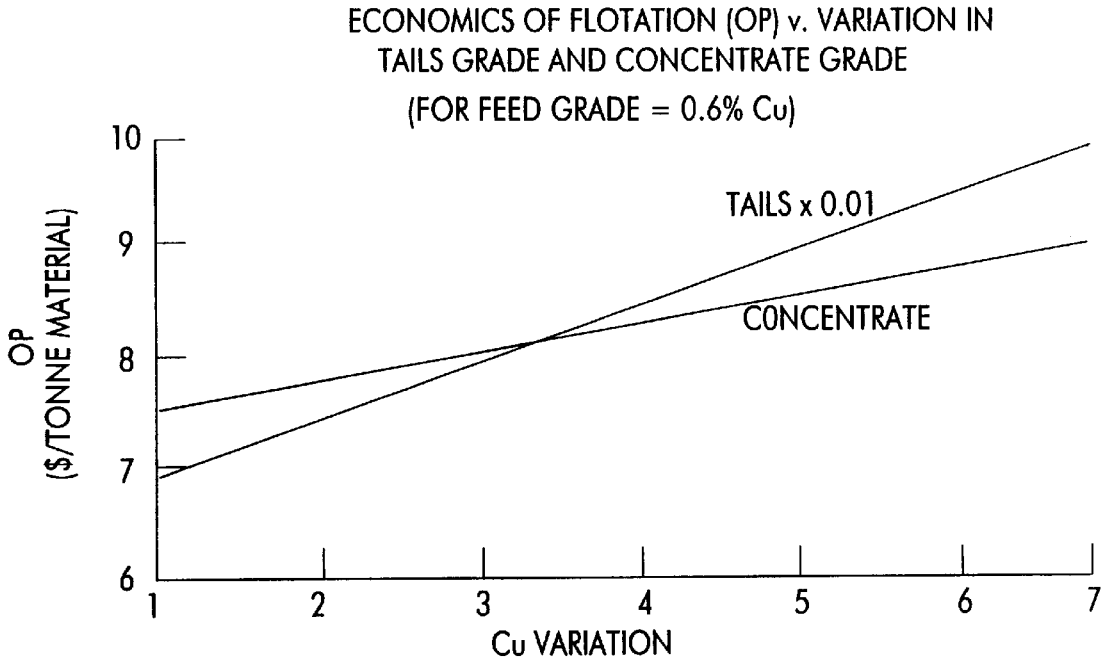
FIG. 4 is a graph illustrating a relationship between Operating Profit and tails concentration.

Another important aspect of the Bousquet 2 ore body is its highly variable copper grade within the ore body. Copper head grade varies from about 0.2% to about 1.5% copper. Such variations have an important effect on economical variability in copper concentrate grade and flotation tails grade. FIG. 4 illustrates the OP value variation as a function of a flotation tails variation and a concentration grade variation for a head grade of 0.6% copper at fixed metal and consumable prices. From that figure, it is evident that flotation tails grade is more critical economically than is flotation concentrate grade. This difference is attributable mainly to cyanide costs. On the other hand, if copper head grade is much higher, copper concentrate has more impact on the economical value of the flotation circuit because of high metal output.

Overall Economics

In view of the foregoing, Bousquet has the following economical equation:

$$OP = \text{metal revenue} - \text{smelting cost} - \text{operating costs}$$

This equation reflects the objective of optimizing financial return of the operation integrating market conditions. This equation does not direct automatically maximizing the value of the concentrate grade or minimizing the value in flotation tails. Under some conditions the expert system may take action which results in decreasing metallurgical performance in order to increase economic performance of the mineral processing operation. As a result, this equation creates rather fuzzy metallurgical set points. In other words, the economic optimum is a function of many variable integrations and does not correspond to one set of metallurgical parameters. Also, it must be realized that minimum achievable flotation tails do exist as well as a maximum achievable concentrate grade. These practical achievable values serve as boundary limits for the expert system. Like any other processes and, because of the variable dependence, as the optimum is approached, the process becomes more and more sensitive to perturbations. For example, there is process dependence because increasing concentrate grade results eventually in increasing flotation residues metal content. The objective is to maintain the operating conditions at the boundary limits of both concentrate grade and flotation residues recognizing that as boundary limits are approached, it is more difficult to maintain stability or alternatively the process is more susceptible. Probability factors (PF) described earlier reflect this important aspect of the process and eliminate the situation of bringing the operation in non-practical, undesirable, and unprofitable operating areas.

In controlling the flotation circuit in accordance with this invention, it is then possible to establish an economical link between flotation, subsequent cyanidation, and subsequent detoxification. This link is established by evaluating the flotation tails as they reflect gold recovery in the flotation operation considering their specific payable value at a smelter, as well as evaluation of such tails as they represent feed to the cyanidation operation.

The invention involves a determination and/or estimate of the amount of metal in the flotation tails. The invention also determines the amount of cyanicides, more specifically, copper in the Bousquet situation, which can be dissolved in cyanidation per unit percent of copper in the tails, which is a function of the mineralogical composition of the ore entering the flotation operation. The invention also determines a relationship between the cyanicide component of the flotation tails and consumption of cyanide, and also between flotation tails grade and consumption of detoxification reagent. Determination of how much copper or other cyanicide components will actually dissolve and affect cyanidation performance allows determination of the economic impact of increasing or decreasing flotation tails.

NSR Flotation and NR Leach

In accordance with this invention, the operating profit discussed above is expressed more specifically as:

$$OP=NSR_{flotation}+NR_{leach}$$

where

OP: operating profit;

$NSR_{flotation}$: Net Smelter Return from the flotation circuit obtained from the difference between metal revenues (payable metals contained in the concentrate such as gold, copper and others including silver) and smelter charges; and $NR_{leach}$: Net Return from the leaching circuit obtained from the difference between metal revenues (gold) and leach circuit operating costs, including cyanide detoxification reagents.

The OP, $NSR_{flotation}$, and $NR_{leach}$ units are in terms of net profit-dollars per tonne of ore treated. The costs of the cyanidation process which follows flotation of gold-copper ores represents a major distinction between flotation of gold-copper ores and copper ores, as the flotation strategy is affected by the leach circuit.

For the $NSR_{flotation}$ parameter, copper revenues and smelter charges are determined by using the terms and conditions of the applicable smelter contract in combination with on-line analysis of the final concentrate copper grade and the production rate (tph, tonnes per hour) via on-line mass balance calculations. Gold revenues can be included in this parameter if either on-line gold analysis is available or if it can be correlated to another element of the flotation circuit and if gold variations can be controlled through flotation variable adjustments. In some instances gold recovery is a function of mineralogy, which does not allow control during flotation. For example, some gold may be free while some is entrained in gangue. When it is not feasible to determine or estimate the gold concentration on-line or to control gold recovery within the flotation circuit, gold revenues are preferably not used in the determining $NSR_{flotation}$, because it will result in undesirable perturbations in the OP calculations. Gold revenues are also not used if they are relatively small in relation to copper revenues, that is, if the economic contribution of gold to the $NSR_{flotation}$ equation is not substantial.

For the $NR_{leach}$ parameter, similarly, gold revenues can be included if variations in gold recovery can be controlled by physical or chemical adjustments in the flotation operation. For gold-copper ores, the $NR_{leach}$ operating cost component is primarily a function of cyanide and detoxification reagent consumption, which is a function of the cyanicide nature of the minerals associated with the flotation tails. Reduction of $NR_{leach}$ operating costs can be achieved by reducing the cyanicide element, such as copper mineral, content of the flotation tails. The relationship is therefore determined between the flotation tails copper content, the nature of the copper mineralization, and the corresponding reagent consumption.

The foregoing allows determination of the costs which relate to an increase in flotation tails copper grade, and of the savings which relate to a decrease in flotation tails copper grade. In particular, it is determined how much increase in copper in the cyanide leach circuit solution would result from an increase of a set percentage of copper in the tails. It is then determined how much additional consumed cyanide would result from this increase in copper in the cyanide solution. And it is further determined how much additional detoxification reagent would result from this increase in copper in the cyanide solution.

Ratio Evaluation

In the case of a copper-gold ore such as the Bousquet ore, a cyanide consumption model is accessible from an understanding of the cyanidation process and how it relates to variations in copper concentration. This involves determination of an applicable copper dissolution rate (CDR), cyanide consumption ratio (CCR), and reagent detoxification consumption ratio (RDCR). The CDR is determined by measuring, at regular intervals, the dissolved copper concentration of the cyanidation circuit solutions. The dissolved copper concentration is then related to the actual copper grade measured in the flotation tails. These measurements are performed by techniques which provide measurements within a reasonable time period taking into consideration process residence time. Measurement techniques include manual sampling and conventional laboratory techniques for measuring copper in solution, or preferably using an on-line x-ray fluorescence analyzer. The CDR is calculated as the mass of copper dissolved/mass of copper in flotation tails. In particular, CDR is calculated as follows:

$$CDR=[(\text{cyanidation solution flowrate})\times(\text{copper concentration}[\%\ \text{Cu or ppm}])]/[(\text{flotation residues solid flowrate})\times(\text{flotation tails copper grade}[\%\ \text{Cu}]].$$

CDR can be expressed in percent and becomes an indicator of mineralogical changes in the ore as for given flotation copper tails grade. The CDR accounts for the fact that for a given tails grade, mineralogical variances result in a different amount of copper being dissolved in the cyanide leach circuit.

The solid and solution flowrates referred to above are determined by use of suitable flowmeters for slurries and solutions. Alternatively, they can be determined by a mass balance computer program for flotation tails solid flow calculations in combination with density gauges.

Figure 5:
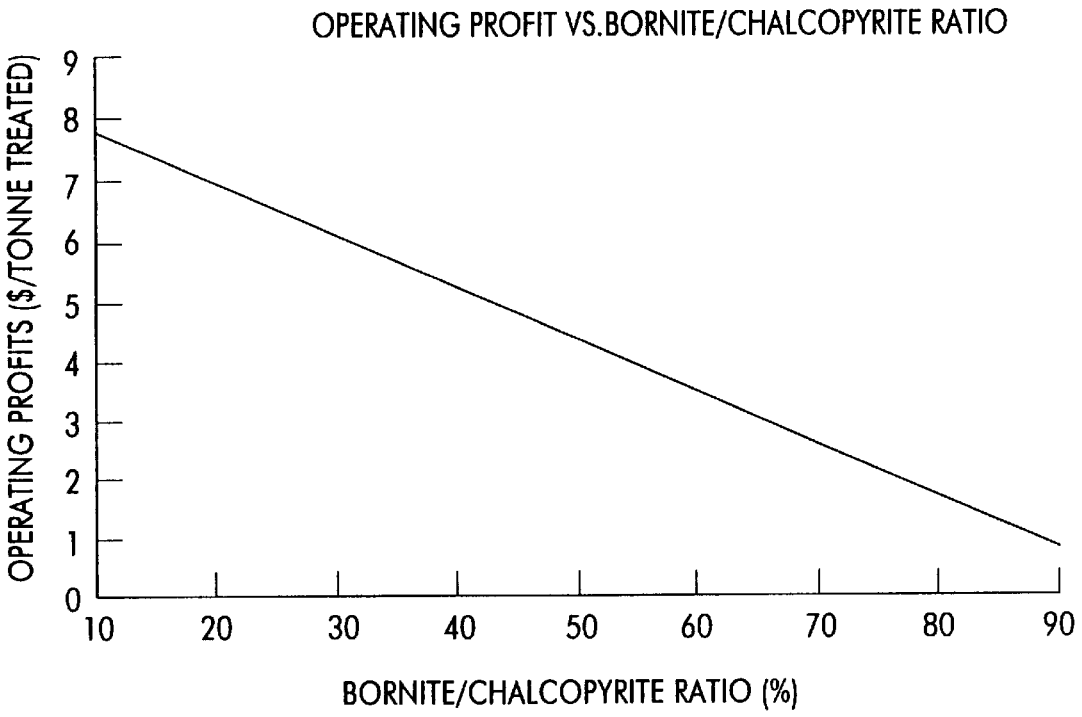
FIG. 5 is a graph illustrating a relationship between Operating Profit and mineralogy expressed as a ratio of bornite to chalcopyrite.

The CDR parameter varies as a function of the different copper minerals processed. For example, if only bornite is present, the CDR is equal to approximately 70%. If only chalcopyrite is present, the CDR is on the order of about to 6%. The CDR fluctuates as different copper mineral components coexist in different ratios in the tails. For the Bousquet ore, FIG. 5 illustrates how OP is affected by changes in CDR corresponding to different ratios of bornite to chalcopyrite. The CDR is therefore calculated on-line on a real-time basis so the OP value reflects changes in mineralogy. In this manner it can be seen that the economics of the leaching circuit, as affected by mineralogy, are used to directly affect operation of the flotation circuit.

A factor relevant to the CDR value is that conventional gold ores present cyanide consumption levels that exceed stoichiometric requirements for gold even in the absence of specifically recognizable cyanicide minerals. This nominal or background cyanide consumption results from cyanide side reactions with ore background constituents and/or air used during leaching. In the case of more refractory ores such as from Bousquet, this background cyanide demand is significantly exceeded by demand from various copper minerals. The CDR, as noted above, is used to predict the associated cyanide consumption that relates to the relative contributions of the copper minerals occurring in the ore. The cyanide consumption associated with CDR, in conjunction with background cyanide consumption, constitute the CCR. The cyanide detoxification reagents consumption associated with CDR, in conjunction with background cyanide detoxification reagent consumption, constitute RDCR. The CCR and RDCR are proportional to each other, and both are actually used to define the control objectives of the process controllers. In particular, they represent the requirements for maintaining proper performance of the cyanidation and detoxification processes. CCR and RDCR therefore represent the actual total demand of total ore reagents for the specific processes they represent.

The on-line control strategy is therefore based on the relationship developed via the CCR and RDCR in order to control reagents addition. The on-line control strategy however does not allow instantaneous on-line adjustment of the CCR and RDCR relationship because it would result in undesirable perturbations in the OP calculations. In other words, actual process conditions which are inherent deviations around the set points and the resultant response actions should not be integrated into the OP calculations. These conditions have to be isolated from the copper mineralogical ore changes which do related to the CDR and represent the key elements to be controlled. In summary, the requirement is to avoid transferring to the OP calculation, all the perturbations generated by the process controllers for cyanide in the leach circuit and/or required reagents(s) associated with detoxification.

Although the CCR and RDCR relationships are held constant for most of the time, CCR and RDCR accuracies should be validated periodically and re-calibrated, if necessary. As a general guideline, these values should be re-calibrated if the cyanide background ore demand is subject to a significant and stable mineralogical change (i.e., not a spike) which does not relate to the control objectives of the CDR parameter.

With specific regard to CCR, a database is created in which cyanide consumption is expressed in terms of grams of cyanide consumed per gram of copper in solution. This calculation is made by measuring actual cyanide consumption on a real-time basis. Cyanide flowmeters or other types of cyanide flow estimators are used. Having determined the to cyanide addition flowrate, the dissolved copper concentration, and the leach circuit cyanidation solution flowrate, the CCR calculation is as follows:

CCR=cyanide flowrate/(leach circuit cyanidation solution flowrate×copper concentration)

With regard to the RDCR, it is the ratio of grams detoxification reagent per gram copper, and is determined as follows:

RDCR=detoxification reagent flowrate/(detoxification solution flowrate×copper concentration)

The detoxification reagent is typically $SO_2$/air, peroxide, Caro's acid, or the like.

In situations where the cyanide consumption (and/or detoxification reagent) is not linearly proportional to the copper concentration, a more mathematically complex model (e.g., quadratic, exponential, or other) is used. At a very low dissolved copper concentration, a constant is inserted in the above CCR equation, as cyanide would still be consumed by background pyrite and or other low cyanide constituents even if there is little or low copper in solution. The same is true for the RDCR equation, as detoxification reagent would nonetheless be consumed by oxidation or side reactions.

Upon determination of CDR, CCR and RDCR according to the foregoing, the consumption of reagents in the cyanidation and post-cyanidation detoxification process are integrated into the OP determination. For example, upon an increase in 0.02% of the copper grade in the flotation tails, the reagent consumption costs increase as follows:

Reagent consumption costs=0.02×flotation tails solids flowrate×CDR×(CCR×cyanide price+RDCR×detoxification reagent price)where cyanide and detoxification reagent prices are expressed in dollars per weight unit.

It can be seen that by integrating reagent consumption costs into the OP calculation, it is possible to enhance the overall economic value of both the cyanidation and flotation processes. By using both $NSR_{flotation}$ and $NR_{leach}$ in the OP determination, the reagent allowance for copper consumption of cyanide, the reagent allowance for detoxification, and the copper concentrate economic value are articulated through an expert system (rule-based type of programming), which allows both processes to be integrated and economically enhanced on a real-time basis. An overall detailed description of the expert system is provided in Appendix A.

Further illustration of the invention is provided by the following example:

EXAMPLE

The expert system collects data from different measurement devices and stores them in the expert system database. These devices are instrumentation and assay analyzers, as follows:

Courier 30 AP—Cu, Fe, Zn, % solids by weight of the flotation streams

Anachem 2090—Leach tanks cyanide concentration (in solution)

X-met—Leach tanks copper concentration (in solution)

The expert system then decides what is the next logic step it should take.

First, an evaluation of the operating profits is performed (OP, $OP_{conc}$, $OP_{tail}$).

A list of symbols used is as follows:

$Cu_p$: Copper price (\$/Kg of copper produced)

SMC: Smelting Charge (\$/tonne of concentrate produced)

ZP: Zinc Penalty (\$/tonne of concentrate produced)

SAC: SAmpling Cost (\$/tonne of concentrate produced)

AC: Assay Cost (\$/tonne of concentrate produced)

RC: Refining charge (\$/Kg of copper produced)

$CN_p$: Cyanide price (\$/Kg)

$SO2_p$: $SO_2$ price (\$/Kg)

RDCR: Reagent for Detoxification Consumption Ratio (in this case, $SO_2$, $gSO_2$/g Cu in solution)

CCR: Cyanide Consumption Ratio (gNaCN/g Cu in solution)

$REC_{Cu}$: Copper RECovery (%)

CDR: Copper Dissolution Rate (ppm/%)

$LEA_{Cuflow}$: LEAching circuit copper in solution flowrate (Kg/h)

$CONC_{rate}$: Final CONCentrate solid flow rate (TPH)

$CONC_{Cu}$: Final CONCentrate copper grade (%)

$TAIL_{Cu}$: Final TAIL copper grade (%)

$FEED_{Cu}$: Flotation FEED copper grade (%)

$FEED_{rate}$: Flotation FEED solid rate (TPH)

$LEA_{ps}$: First LEAching tank percent solid (%)

$LEA_{Cu}$: First LEAching tank copper concentration in solution (ppm)

OP: Actual Operating Profit ($/tonne of ore treated)

$NSR_{flotation}$: Flotation Net Smelter Return ($/tonne of ore treated)

$NR_{leach}$: Net Return of the leaching circuit ($/tonne of ore treated)

$PF_{tail}$: Probability Factor for final tail (%)

$PF_{conc}$: Probability Factor for final concentrate (%)

$OP_{conc}$: Operating Profit for a concentrate grade increase ($/tonne of ore treated)

$OP_{tail}$: Operating Profit for a final tail grade decrease ($/tonne of ore treated)

$OPC_{conc}$: Operating Profit for a concentrate grade increase Corrected by the probability factor ($/tonne of ore treated)

$OPC_{tail}$: Operating Profit for a final tail decrease Corrected by the probability factor ($/tonne of ore treated)

$LEA_{sin}$: LEAching circuit solution flow rate (TPH)

The determination of the Operating Profit requires use of several monetary constants. These constants can be changed from time to time in relation with market conditions, for example, in the case of the copper price. These constants with their value used within the actual example are as follows:

$CU_p$ 1.50

SMC 200

ZP 9.00

SAC 1.00

AC 4.50

RC 0.40

$CN_p$ 2.00

$SO2_p$ 0.40

RDCR 9.0

CCR 6.0

As mentioned earlier, several instruments provide data from the field (concentrate grade, tail grade, etc.) to the expert system. In this example, values obtained from the instrumentation are as follows:

$CONC_{Cu}$ 21.01

$TAIL_{Cu}$ 0.06

$FEED_{Cu}$ 0.56

$FEED_{rate}$ 80

$LEA_{ps}$ 58.9

$LEA_{Cu}$ 278

These data allow the expert system to calculate the value of OP, $OP_{conc}$ and $OP_{tail}$. The OP value can be determined by the equation presented above, namely:

$$OP=NSR_{flotation}+NR_{leach}$$

Thus, the first steps consist of determining $NSR_{flotation}$ and $NR_{leach}$ value.

$NSR_{flotation}$:

As presented above $NSR_{flotation}$ can be obtained by the following equation:

$$NSR_{flotation}=\text{metal revenue}-\text{smelting costs}$$

As presented above OP can be obtained by the following equation:

$$OP=\text{metal revenues}-\text{smelting costs}-\text{reagent costs}$$

Metal Revenue (MR) for one tonne of concentrate:

$$MR=(CONC_{Cu}-1)*Cu_p*1000/100$$

$$MR=(21.01-1)*1.50*1000/100$$

$$=300.15$$

Smelting cost (SC) for one tonne of concentrate:

$$SC=SMC+ZP+SAC+AC+\text{refining cost}$$

$$\text{Where refining cost}=(CONC_{Cu}-1)*RC*1000/100$$

$$=(21.01-1)*0.40*1000/100$$

$$=80.04$$

$$SC=200+9+1+4.50+80.04$$

$$=294.54$$

$$NSR_{flotation}=300.15-294.54$$

$$=5.61\ \$/\text{tonne of concentrate}$$

This NSR value can be converted in $/tonne of ore treated by using the following equation:

$$\text{Tonne of concentrate}=\text{tonne of ore treated}*FEED_{Cu}*REC_{Cu}/(100*CONC_{Cu})$$

Above equation can be transformed to obtain:

$$\text{Tonne of concentrate}=FEED_{Cu}*REC_{Cu}/(100*CONC_{Cu})\ \text{Tonne of ore treated}$$

Where $$REC_{Cu}=[(CONC_{Cu}*FEED_{Cu})-(CONC_{Cu}*TAIL_{Cu})]/[(CONC_{Cu}*FEED_{Cu})-(FEED_{Cu}*TAIL_{Cu})]$$

$$=[(21.01*0.56)-(21.01*0.06)]/[(21.01*0.56)-(0.56*0.06)]$$

$$=89.54$$

Then, $$NSR_{flotation}(\text{per ore treated})=NSR_{flotation}(\text{per tonne of concentrate})*FEED_{Cu}*REC_{Cu}/(100*CONC_{Cu})$$

$$=5.61*0.56*89.4/(100*21.01)$$

$$=0.13$$

(Reagent costs are considered marginal in this example.)

$NR_{leach}$

As described above, $NR_{1each}$ can be expressed as:

$$NR_{leach}=\text{metal revenues}-\text{operating costs}$$

(Metal revenues are not considered in this example because they cannot be controlled via flotation adjustment.)

Operating costs:

The operating costs are determined by cyanide and $SO_2$ costs. These costs are determined by the following calculations:

$$CONC_{rate} = FEED_{rate} * FEED_{Cu} * REC_{Cu} / (100 * CONC_{Cu}) = 80 * 0.56 * 89.5 / (100 * 21.01) = 1.91$$

$$LEA_{\sin} = (FEED)_{rate} - CONC_{rate}) * (100 - LEA_{ps}) / LEA_{ps} = (80 - 1.91) * (100 - 58.9) / 58.9 = 54.49$$

$$CDR = (LEA_{Cu} * LEA_{\sin}) / (TAIL_{Cu} * (FEED_{rate} - CONC_{rate})) = (278 * 54.49) / (0.06 * (80 - 1.91)) = 3233$$

$$LEA_{Cuflow} = CDR * TAIL_{Cu} * (FEED_{rate} - CONC_{rate}) * 1000 / 10^6 = 3233 * 0.06 * (80 - 1.91) * 1000 / 10^6 = 15.15$$

i) Cyanide cost $$\text{Cyanide cost} = LEA_{Cuflow} * CCR * CN_p / FEED_{rate} - CONC_{rate}) = 15.15 * 6 * 2 / (80 - 1.91) = 2.33$$

ii) $SO_2$ cost $$SO_2 \text{ cost} = LEA_{Cuflow} * RDCR * SO2_p / FEED_{rate} - CONC_{rate}) = 15.15 * 9 * 0.40 / (80 - 1.91) = 0.70$$

Thus, $$NR_{leach} = 0 - 2.33 - 0.70 = -3.03$$

$$OP = NSR_{flotation} + NR_{leach} \text{ (as stated earlier)} = 0.13 - 3.03 = -2.90$$

By using the same methodology, $OP_{c+2\%}$ and $OP_{t-0.02\%}$ can be determined. $OP_{conc}$ is obtained by adding a 2% concentrate grade increase while maintaining flotation tail grade unchanged. $OP_{t-0.02\%}$ is obtained by reducing flotation tail grade by 0.02% while maintaining flotation concentrate grade unchanged. In the example, we have:

$$OP_{c+2\%} = -2.42;\ OP_{t+0.02} = -1.88$$

Having found the OP, $OP_{t-0.02\%}$ and $OP_{c+2\%}$ the next step consists of determining the probability factors (PF) for the calculation of the Operating Profit Corrected ($OPC_{t-0.02\%}$ and $OPC_{c+2\%}$).

$OPC_{t-0.02}\%$

Based on the historical value and the knowledge of the flotation circuit, the following equation provides the probability factor for the flotation tail ($PF_{tail}$):

$$PF_{tail} = [TAIL_{Cu} - (0.0479 * FEED_{Cu} + 0.0446)] / 0.04$$

This equation is derived by regression analysis of the historical value of the flotation circuit. It can be seen that the probability to decrease the flotation tail grade is related to the actual flotation tail grade (the lower this value is, the lower is the value of PF). Inversely, if flotation feed copper grade is higher, the probability factor is lower for a given actual flotation tail grade. As mentioned above, the probability factor provides an evaluation of the potential related to a decrease of flotation tail grade. Probability factor value is limited to the range 0 to 100%. In the example:

$$PF_{tail} = [0.06 - (0.0479 * 0.56 + 0.0446)] / 0.04 = 0\%$$

In the present example, the OP values have negative values. In this case the preceding equation is converted in a way that the potential Operating Profit gain is adjusted by the Probability Factor.

As noted above, the following equation is used for $OPC_{tail}$ calculation:

$$OPC_{t-0.02\%} = OP + (OP_{t-0.02\%} - OP) * PF_{tail} = -2.90 + (-1.88 - (-2.90)) * 0\% = -2.90$$

$OPC_{conc}$

Similarly as for $PF_{tail}$, $PF_{conc}$ is derived from flotation circuit knowledge regarding potential increase of the concentrate copper grade in relation with the actual concentrate grade. The equation is:

$$PF_{conc} = [4 - (CONC_{Cu} - 20)] / 4$$

Again, $PF_{conc}$ value is limited between 0 and 100%. In the example, we have:

$$PF_{conc} = [4 - (21.01 - 20)] / 4 = 75\%$$

As for $OPC_{t-0.02}\%$, $OPC_{c+2}\%$ is given by the following equation:

$$OPC_{c+2\%} = OP + (OP_{c+2\%} - OP) * PF_{conc} = -2.90 + (-2.42 - (-2.90) * 75\% = -2.54$$

In summary, in this example there are the following values for $CPC_{c+2\%}$ and $OPC_{t-0.02\%}$:

$$OPC_{c+2\%} = -2.54;\ OPC_{t-0.02\%} = -2.90$$

Therefore, the $OPC_{c+2\%}$ value is greater than the $OPC_{t-0.02\%}$ value. When this statement is true for a predetermined period such as 30 minutes or more the expert system examines the flotation circuit status. This is achieved by analyzing the circuit for overloading conditions. It consists of examining whether there are high levels in one of the following pump boxes: Rougher concentrate, scavenger concentrate or 2d cleaning stage feed. There can also be overloading conditions when the variable speed drive of the regrind ball mill or the first cleaner is high.

In the present example, there were acceptable levels in these pump boxes and pump speed.

During examination of the flotation circuit status, the expert system then evaluates whether the circuit is is underloaded, balanced or overloaded. This status is given by the speed of the regrind pump and the speed of the first cleaner pump. The table below explains the different situations.

| | Pump speed limits | This example |
|---|---|---|
| Underloaded | <80% | Regrind = 65%, Cleaner = 60% |
| Balanced | 80% > pump speed < 90% | |
| Overloaded | >90% | |

The circuit is thus underloaded and ready to be optimized.

When this statement is true for a predetermined period such as 5 minutes or more and the value of the $OPC_{c+2\%}$ is higher than the $OPC_{t=0.02\%}$ for a predetermined period of time such as 30 minutes the expert system will then optimize the flotation circuit to increase the concentrate grade.

After the circuit status has been identified, the subsequent steps consist of selecting the appropriate route to follow taking into account actual internal status of the circuit. In an expert system language, this process identifies the following: 1) Primary cause 2) secondary cause 3) action. These identifications can be explained as follows:

Primary Cause:

The system determines the flotation step that should preferably be adjusted considering the objective that was determined by the previous steps. By looking at the internal status of the flotation circuit, the system can decide between manipulating the rougher cells operating variables, cleaner cells operating variables, etc.

For the present example, the flotation stages examined are the roughers, the scavengers, and the $2^{nd}$ cleaners. The evaluation is performed by looking at rougher concentrate copper grade, scavenger concentrate copper grade, and $2^{nd}$ cleaner feed copper grade. These grades values are compared with the acceptable lower limits. These lower limits are calculated by multiplying by 1.1 the average of the grade values that were obtained during the preceding 24 hours.

In the present example, the limits are respectively 6.5% for the rougher concentrate, 1.8% for the scavenger concentrate, and 10% for the $2^{nd}$ cleaner feed. The rule first checks the rougher concentrate. The rougher concentrate in this example is 6%. Thus, the expert system determines that the rougher is the primary cause since the assay value is under the acceptable lower limit. This means that adjustments on the rougher cells have the highest potential to provide desired economical gain.

Secondary Cause:

This step allows the system to identify the specific variable (air flow rate, pH value, others) that should be manipulated considering the flotation stage with the highest potential of improvement that has been identified during the preceding step.

In the present example, the following logic is performed considering that the rougher stage has been evaluated to be the most appropriate stage on which adjustments should be performed. The possibilities are performing adjustments on the air flow and the frother addition flow. The following logic is performed to decide which is the right action that should be taken. The actions are alternated between the air and frother in an orderly fashion. The air is to be changed twice for each change in frother flow. In this example the air is to be changed.

Action:

This step determines the amplitude of the action that should be taken considering the actual value of the variable that is to be adjusted.

In the actual example, the expert system has identified that the air flow rate of the rougher cells should be adjusted. The actual values of the air flow rate in the three rougher cells are as follows:

75 cfm 1 rougher 80 cfm 2 rougher 90 cfm 3 rougher

Figure 10:
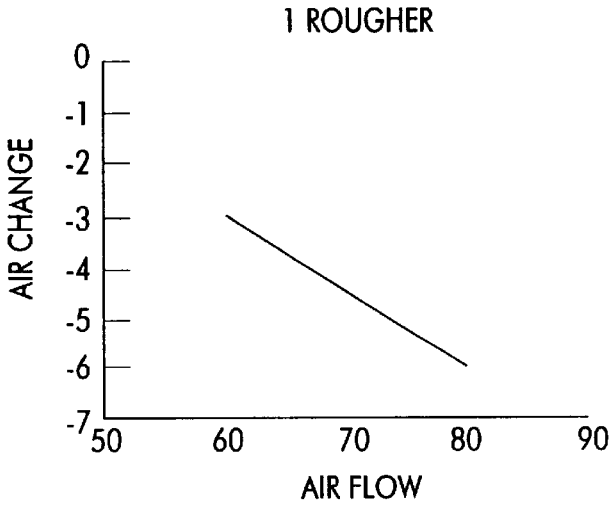
FIG. 10 is a graph illustrating logic applied to a rougher (1) as discussed in Appendix A.

The rate of change or the amplitude of the air flow rate change is determined by a fuzzy logic on the air flow rate. Basically, the higher the actual flowrate, the greater would be the amplitude of the change, as illustrated in FIG. 10.

In the present example, the change in the air flow rate of the different cells is to be as follows:

1 rougher=−5 cfm 2 rougher=−4.5 cfm 3 rougher=−5 cfm

These adjustments are automatically performed by the expert system. At the same time, the following message is provided to the operator:

Stable Circuit $OPC_{conc} > OPCtail$

Cause: Rougher operation to be improved

Action: Rougher air flow rate reduction

After the action has been performed by the expert system, a verification of the action success is obtained. This allows the system to verify if the objective that was desired has been obtained. Basically, the verification is performed according to where it has been performed. During this verification, the expert system has a criteria (OP value, copper grade value, others) to examine after a certain period of time (typically related to the residence time and the dynamic of the variable manipulated) that allows the flotation circuit to react to the change that was accomplished.

In the example, since this action is taken at the rougher and toward raising the concentrate, the verification is made 1.5 hours after the change. The success of this action is granted if the OP value after 1.5 hours is higher than the original value of the OP. In this case the success was granted and the expert system can once again start taking actions.

As various changes could be made in the above embodiments without departing from the scope of the invention, it is intended that all matter contained in the above description shall be interpreted as illustrative and not in a limiting sense.

Appendix A

Overall Description of the Expert System

The expert system consist of two knowledge bases, each having its own utility. The first one is used to validate the data coming from the DCS (Distributed Control System). The second one is used to determine what is the appropriate action to take on the flotation circuit.

1) Knowledge Base 1

In this part of the system, data collected by the database is treated to validate the values. In order to validate the values obtained from the DCS, the system compares these values with high and low values. So to be validated the value must be between these limits. The values are then put in the database under a validated name.

Ex. Value from DCS Þ wic_102. rm_alim_ds_vp.@float

Value validated Þ wic_102. rm_alim_ds_scs.@float

Data is validated at least once and up to several times a minute. This is to avoid the use of a data that is not realistic of the present status of the flotation circuit.

Ex. Assay from the Courier 30AP Þ 45 minutes

Slurry flowrate Þ 5 minutes

NSR value Þ 15 minutes

These values might seem high for validation times, but the different values are not automatically transmitted to the expert system database. The average rate of transmission is two minutes and the knowledge base scanning time is two minutes also.

2) Knowledge base 2

This section describes the different possibilities that can happen while the expert system is in operation. The expert system consists of eight possible applications that can bring an action on the flotation circuit. The applications are mostly directed toward having a circuit in a balanced state. There are six of these applications that have this mission. The other two are less significant. The first of these two is for the different configuration possibilities of the cleaners and the other one is used to determine if one of the primary causes is a saturated state.

The flotation circuit is described in terms of three different statuses: underloading, balanced, and overloading.

The following sections will describe in order:

1. OP (Operating Profit)
2. OP modifications
3. 8 application rules
4. Primary causes
5. Secondary causes
6. Actions

1. OP

The OP formula is an evaluation of the flotation and cyanidation processes. This formula was made to be able to determine the situation in the flotation circuit while being able to anticipate the cost in the cyanidation process. OP is therefore able to bring an economical link between the flotation circuit and the cyanidation process. The OP is divided into two parts: a) flotation cost and revenues, b) an evaluation of the probable cost link to the cyanidation process. This link is the key of the application since it contemplates the entire mill before adjusting the flotation process.

The OP is summarized in the following formulas:

1.1) Metal Revenue (MR) for one tonne of concentrate:

$$MR=(CONC_{Cu}-1)*Cu_p*1000/100$$

1.2) refining cost $$\text{refining cost}=(CONC_{Cu}-1)*RC*1000/100$$

1.3 Smelting cost for one tonne of concentrate:

$$\text{Smelting cost (SC)}=SMC+ZP+SAC+AC+\text{refining cost}$$

1.4) Copper recovery $$REC_{Cu}=[(CONC_{Cu}*FEED_{Cu})-(CONC_{Cu}*TAIL_{Cu})]/[(CONC_{Cu}*FEED_{Cu})\ (FEED_{Cu}*TAIL_{Cu})]$$

1.5) $NSR_{flot}$($/tonne of concentrate)

$$NSR_{flot}=\text{Metal revenues}-\text{smelting costs}$$

1.6) $NSR_{flot}$($/tonne of ore treated)

$$NSR_{flot}=NSR_{flot}(\$/\text{tonne of concentrate})*FEED_{Cu}*REC_{Cu}/(100*CoNC_{Cu})$$

1.7) Leach operating cost 1.7.1) Final concentrate flow rate $$CONC_{rate}=FEED_{rate}*FEED_{Cu}*REC_{Cu}/(100*CONC_{Cu})$$

1.7.2) Leaching circuit solution flowrate $$LEA_{sln}=(FEED_{rate}-CONC_{rate})*(100-LEA_{ps})/LEA_{ps}$$

1.7.3) Copper dissolution rate $$CDR=(LEA_{Cu}*LEA_{sln})/(TAIL_{Cu}*(FEED_{rate}-CONC_{rate}))$$

1.7.4) Leaching circuit copper in solution flow rate $$LEA_{Cuflow}=CDR*TAIL_{Cu}*(FEED_{rate}-CONC_{rate})*1000/10^6$$

1.7.5) Cyanide cost ($/tonne of ore treated in secondary metal recovery circuit)

$$\text{Cyanide cost}=LEA_{Cuflow}*CCR*CN_p/FEED_{rate}-CONC_{rate})$$

1.7.6) $SO_2$ cost ($/tonne of ore treated in secondary metal recovery circuit)

$$SO_2\ \text{cost}=LEA_{Cuflow}*RDCR*SO2_p/FEED_{rate}-CONC_{rate})$$

1.7.7) $NR_{leach}$ $$NR_{leach}=\text{metal revenues}-\text{operating costs (Cyanide and } SO_2$$

1.8) OP $$OP=NSR_{flot-NRleach}$$

2)OP Modifications

The OP itself is not an indication of the best modification that can be made to flotation. Two concepts relevant to OP modification are the OP value modified to determine the OP (tails) and OP (concentrate). These two values give a larger value then the OP. This is the first step in evaluating the process situation. The OP (tails) and OP (concentrate) are a good observation of the flotation circuit, but these values do not take into account the practical achievable limits for the particular ore being treated. This is why the OP (tails) and OP (concentrate) must be modified by a probability factor. The OP (tails) and OP (concentrate) then become OPC (tails) and OPC (concentrate). These new values then give a realistic and economical situation of the flotation circuit.

OP (tails): The OP (tails) is in fact an OP formula calculated with a value of the copper in tails minus 0.02% while keeping the concentrate at a stable value. This then provides a realistic economical goal for the flotation circuit.

OP (concentrate): The OP (concentrate) is in fact an OP formula calculated with a value of the copper in concentrate plus 2% while keeping the tails at a stable value. The provides a realistic economical goal for the flotation circuit.

Figure 6:
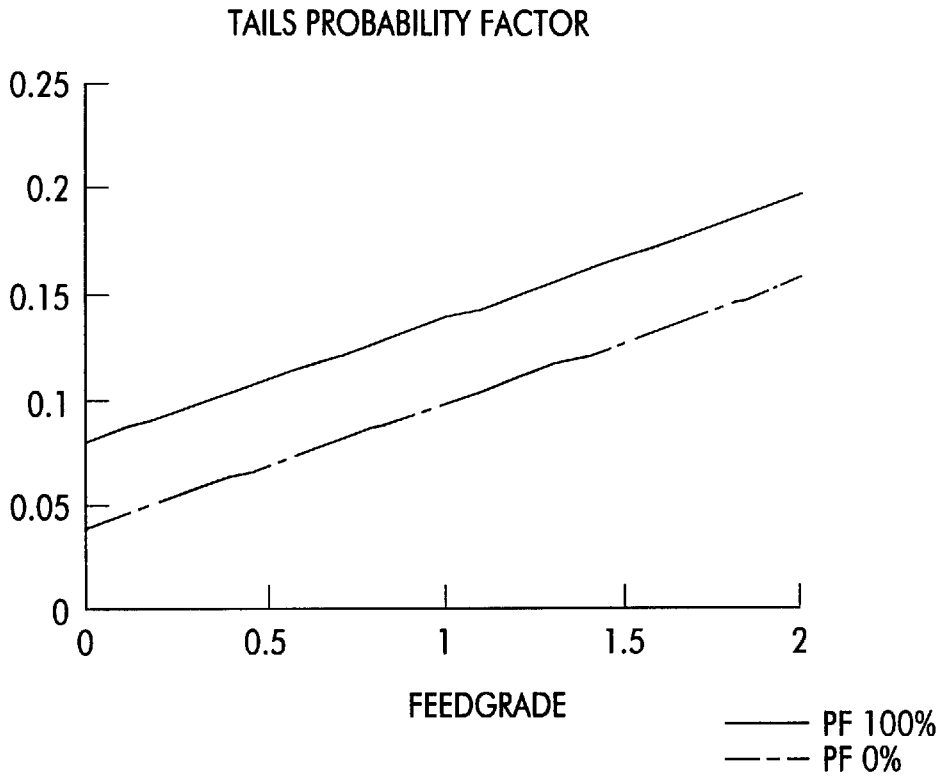
FIGS. 6 and 7 are graphs illustrating probability factors discussed in Appendix A.

PF (tails): The probability factor for the tails is a statistical observation of the last year of production. The high correlation between the feed grade and the tails grade is used to determine this probability factor. The probability factor for the tails is represented by the graphic in FIG. 6.

The formula to evaluate the operating factor is:

$$PF\ (\text{tails})=[Cu\ \text{tails}-(0.0479\ Cu\ \text{feed}+0.0446)]/0.04$$

PF(tails) maximum is 100%, PF (tails)minimum is 0%

Figure 7:
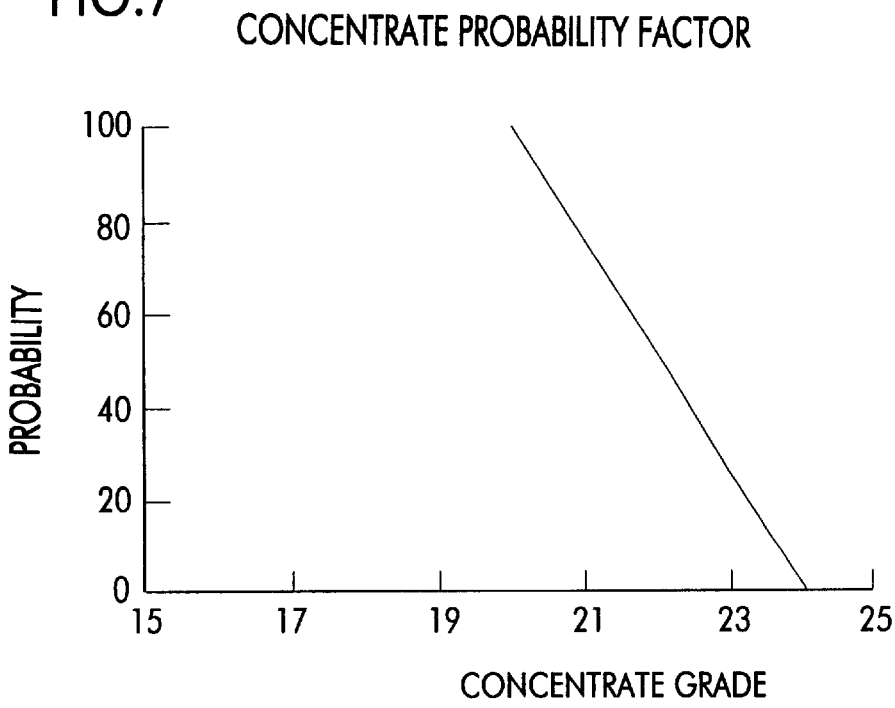

PF (concentrate): The probability factor for the concentrate is correlated to the statistical mean of the concentrate grade for the last year of production. The maximum and minimum value is the mean plus and minus 2%. The probability factor for the concentrate is represented by the graphic in FIG. 7.

The formula to evaluate the operating factor is:

$$nPF\ (concentrate)=[4-(Cu\ concentrate\ -20)]/4$$

PF (concentrate) maximum is 100%, PF (concentrate) minimum is 0%

OPC (tails): The final step in evaluating the OP (tails) modifications is to apply the tails operating factors to the OP (tails). The formula is the following:

$$OPC\ (tails)=OP+(OP_{t-0.02\%}-OP)*PF\ (tails)$$

OPC (concentrate): The final step in evaluating the NSR (concentrate) modifications is to apply the concentrate operating factors to the NSR (concentrate). The formula is the following:

$$OPC(concentrate)=OP+(OP_{c+2\%}-OP)*PF_{conc}$$

3. Eight Application Rules

The eight applications are used to study the diagnostic status of the flotation circuit. The eight applications can be divided into four categories. The categories and applications are the following (A,B,D,O).

| Categories | Applications |
|---|---|
| Configuration | A1-3 cleaner configuration |
| Pump box | B1-Rougher concentrate |
| | B2-Scavenger concentrate |
| | B3-Regrind and 1 cleaner |
| | B4-2 Cleaner feed |
| Saturated (lower or upper limits reached) | D1-Secondary cause saturation |
| Optimisation | O1-OPC (tails) |
| | O2-OPC (concentrate) |

Saturated refers to secondary cause saturation of O1 or O2, which occurs when the secondary cause has reached a high or low limit on each of its parameters, such as pH, air flow, etc. When this occurs a different optimization parameter is investigated.

The eight application rules pass in the same order as in the table above.

4. Primary Cause

This section will explain in more detail the application rules as well as the primary causes. A primary cause is used to find on what flotation cell or what parameter should be modified.

Figure 8:
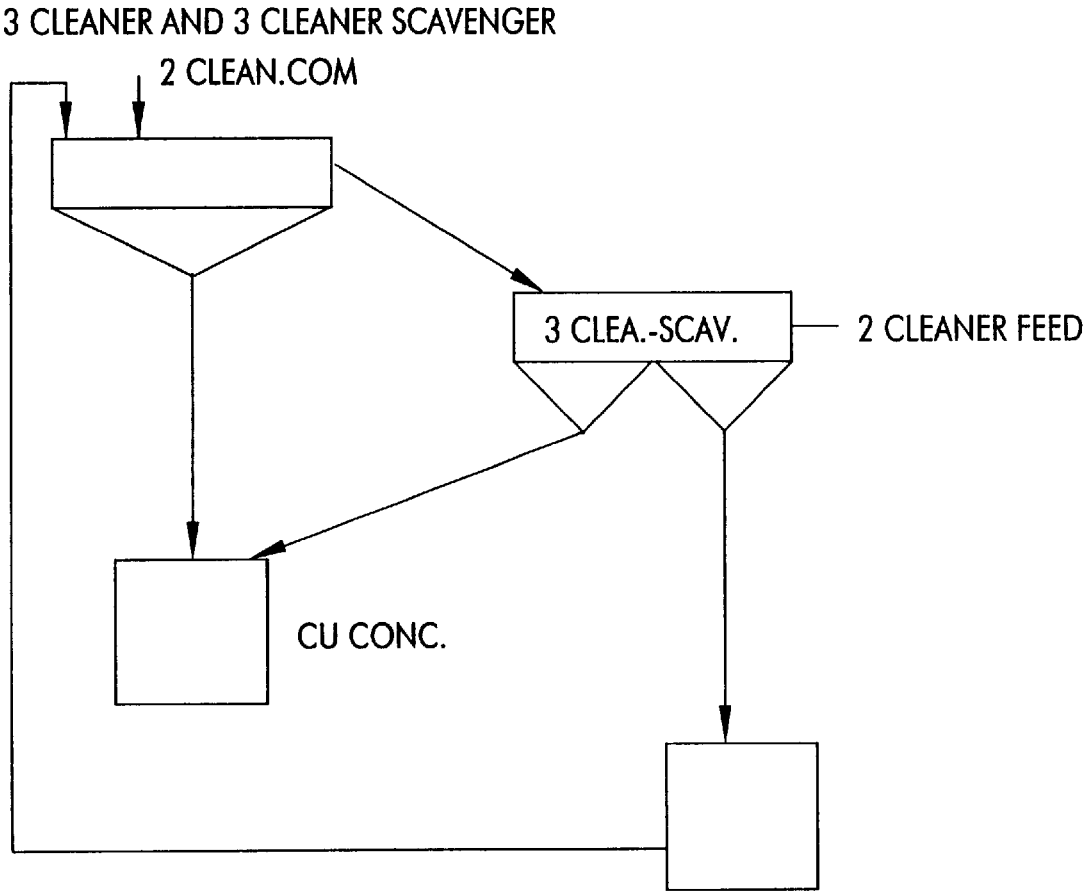
FIGS. 8 and 9 are schematic illustrations of process options discussed in Appendix A.
Figure 9:
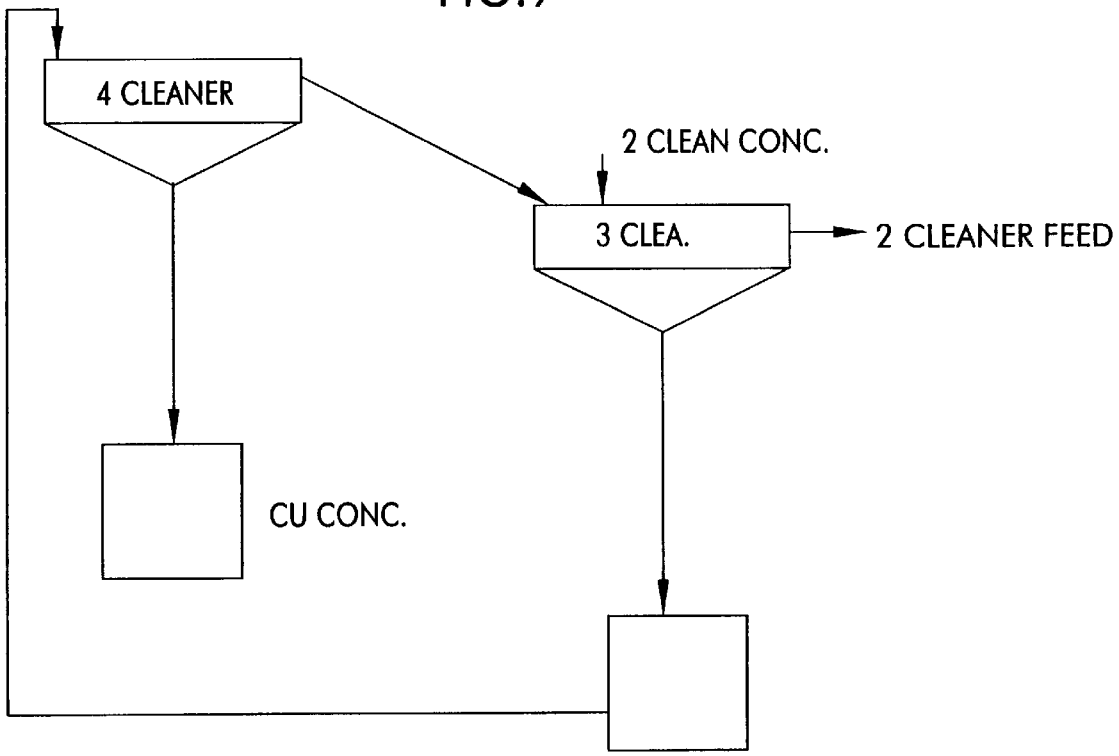

A1-3 cleaner configuration: The 3 cleaner can in the case of Est-Malartic be put in two different configurations. The first option is in 3 cleaner and 3 cleaner-scavenger. This option is the one used most of the time. The second option is in 3 cleaner and 4 cleaner. This option is used when the mill has low feed grade. The second option is therefore used to raise the concentrate value. The 2 options are represented in FIGS. 8 and 9.

This rule is easy and is only used in case of a sudden rise in the feed grade. This is therefore used to put the flotation circuit in 3 cleaner and 3 cleaner-scavenger. This rule will pass if the feed grade is higher than 0.4% for 90 minutes. The expert system will then call the flotation operator via a pager and tell the operator to make this change to avoid an overloading of the circuit.

B1-Rougher concentrate: The B1 rule is a high level in a pump box. This rule will come into action if the high level is maintained for 1 minute. This analysis is defined as the problem. The next step is to find the primary cause.

The expert system then looks at concentrate slurry flowrate to determine the primary cause. This indicates if the problem is coming from the pump or from an inappropriate operating conditions. The pump will be designated as the problem if the flowrate is under 65 usgpm. If the flowrate is over 65 usgpm the expert will find the operation problem among the secondary causes.

B2-Scavenger concentrate: In this case the problem is detected if the pump box is in high level for over 1 minute. In this case there is only one primary cause. This is because there is no action possible coming from the expert system. The only thing the expert system can do is to warn the operator that there is a high level in the cell.

B3-Regrind and 1 cleaner: This application rule is detected if the speed of the variable speed drive is higher than 90% on the regrind or the feed of the 1 cleaner. This statement must be true for at least 5 minutes for it to be validated. This means that the flotation circuit is overloaded and must be unloaded.

There are three possible primary causes. The first to be examined is the OPC(tails) and the OPC (concentrate) values. This is to decide if it is more economical to raise the tails or lower the concentrate. If the value of the $OPC_{tail}$, is higher, it can then be decided to lower the concentrate in order to unload the flotation circuit. In the other case, the expert system will raise the tails in order to unload the circuit.

In the case of raising the tails, there is only one primary cause. This is the OPC value. The expert system then decides to make a move on the rougher or the scavenger. In the other case, it is necessary to look at the grade of the feed in the 2 cleaner. This will enable the system to work on the 1 cleaner or the 2 cleaner. The limit to examine is the mean of the 2 cleaner on a 24 hour base. This mean is a primary cause limit. This limit is calculated in the first knowledge base. If the 2 cleaner assay at the time is higher than the limit, the change will be affected on the 1 cleaner. This is because since the assay is high it is likely the flowrate through the 1 cleaner is too low. In the other case it is the 3 cleaner that is not working properly.

B4-2 cleaner feed: The second cleaner pump box is said to have a problem if the pump box is in high level for over 1 minute. In this situation the primary cause is completely determined by the OP situation. If the OPC(tails)c is larger than the OPC (concentrate)c, the primary cause is the 3 cleaner. In the other case it is the 1 cleaner.

D1-Secondary cause saturation: This rule is used to avoid an effect of having an action limited by a high or low limit. For example, if the system were optimizing a parameter relevant to tails such as pH, airflow, etc., and reached saturation, the system would switch back and optimize concentrate while trying to maintain tails parameter at its present level. This rule will be maintained for 1.5 hours.

O1-OPC (tails): This situation is defined as an optimization mode where there are no high levels (B*) detected. For this rule to pass, the OPC(tails) must be larger than the OPC (concentrate) for 30 minutes.

In this case there are nine primary causes possible. The first one is special but the other eight are related together. Four of the rules are more significant than the others. The others only indicate that the expert system is missing important data and cannot take an immediate action.

The first primary cause is to detect if the feed grade is too high. If the copper feed in the rougher is greater than 2 tph, the expert system will give a message that the flotation circuit is overloaded and that the problem comes from the mill feed grade. There is no action possible in this situation unless the mill operator lowers the mill feed tons.

The second primary cause is active when the circulating load from the cleaner stage is over 50% and the 2 cleaner feed assay is over its mean for 24 hours. This analysis provides the expert system enough information to make an adjustment to the 1 cleaner.

The third primary cause is the same as the second with the exception that the 2 cleaner feed assay is lower than the limit. This information is relevant since the action can now be applied on the 3 cleaner.

The fourth primary cause is activated if the circulating load from the cleaners is under 50% and the rougher concentrate is higher than its high limit. This limit is the mean of the last 24 hours plus 10% relative. The regrind and 1 cleaner variable speed drives must also be under 80%. This cause can also be activated if the circulating load is higher than 50% and the rougher tails is higher than its high limit. In this case the limit is the mean of the last 24 hours plus 10% relative. So if this cause is activated the expert system will make a move on the roughers.

The fifth primary cause is on the scavengers. This one is activated if the circulating load is less than 50% and the scavenger concentrate is higher than its high limit. Its high limit is the mean for 24 hours plus 10% relative. The regrind and 1 cleaner variable speed drives must also be under 80%. In this case the expert system will call the operator via a pager to make a manual change.

The other primary causes are the same as the four proceeding ones, but result from missing assays due to failure of the on-line analyzer. The expert system notifies the operator of this condition.

O2-OPC(concentrate): This situation is encountered when the OPC(concentrate) is greater than the OPC(tails) for over 30 minutes and there are not any of the rules B1 through B4 active. There are nine applicable primary causes in this situation.

The first cause is only applicable when the first or second cell of the 1 cleaner is sent to the final concentrate. This action is done when the ore grades are over 1%.

The second primary cause relates to the roughers. If the rougher concentrate is under its lower limit, the cause is activated. The lower limit is the mean for 24 hours minus 10%.

The third primary cause is active if the rougher concentrate is over its lower level and that the scavenger concentrate is under its lower limit. Its lower limit is the mean for 24 hours minus 10% relative.

The fourth primary cause is from the 3cleaner. When the second and third primary causes are not active and the 2 cleaner feed assay is over its mean for the last 24 hours, this cause is activated. The speed of the regrind pump and 1 cleaner pump variable drives must also be under 80% for any action to take place.

The fifth primary cause is detected for the 1 cleaner. It is the same as the fourth cause with the exception that the 2 cleaner feed assay is under its limit.

The other primary causes are the same as the four proceeding ones, but result from missing assays due to failure of the on-line analyzer. The expert system notifies the operator of this condition.

5. Secondary Causes

These causes will help determine what is the specific change that should be made to the specified cell from the primary cause. The main objective of these causes is to verify whether there is still margin for further action to be taken on the parameter being evaluated. This means that the expert system will look at the higher and lower limit on each action (air, pH, etc.). If the action specified exceeds the limit, the expert systems will pass to the next possible action.

6. Action

The expert system has the possibility to accomplish a set point change or page the operator to deliver a message. Messages given by the expert system are mainly centered around the scavenger, the 2 and 3cleaner. These action are done by changing the air flowrate in these cells. It is also possible to ask the operator to change the configuration of the 3cleaner.

It is also possible to make a direct change to a set point. These changes are made in accordance with a fuzzy logic. The following set points can be changed.

Air rougher

Froth rougher

Air 1 cleaner pH 2 cleaner pH 3cleaner

The fuzzy logic used is directly correlated with the high and low limits of these variables. The graphic in FIG. 10 presents this logic.

In this example, the secondary cause has found that the action should be taken on the 1 rougher. The action is to lower the air flow in the cell. The graphic directs that the action will be larger when the actual flow is closer to its high limit and vice versa.

What is claimed is:

1. A method for controlling a froth flotation system in a mineral processing operation for recovering metal from a metal source, which froth flotation system produces flotation concentrate containing a concentrate metal portion of said metal from said metal source and tails containing a tails metal portion of said metal from said metal source, the method comprising the steps of:

determining a target value for the amount of metal to be directed by the froth flotation system to the concentrate metal portion, determining a probability factor related to the probability of achieving said target value on the basis of historical and diagnostic knowledge of the froth flotation system, and controlling the froth flotation system by a rule-based expert system which adjusts performance of the froth flotation system in part on the basis of said probability factor.

2. The method of claim 1 further comprising the steps of:

determining operating profit data corresponding to operating profit of the froth flotation system, adjusting said operating profit data as a function of said probability factor to produce adjusted operating profit data, and controlling the froth flotation system by said rule-based expert system in part on the basis of said adjusted operating profit data.

3. The method of claim 2 further comprising the steps of:

determining smelting and refining cost data corresponding to costs associated with smelting and refining metal values in the flotation concentrate, determining metal revenue data corresponding to revenue from metal values in said flotation concentrate, and controlling the froth flotation system by said rule-based expert system which adjusts performance of the froth flotation system in part on the basis of said smelting and refining cost data and in part on the basis of said metal revenue data.

4. The method of claim 1 wherein said diagnostic knowledge comprises circuit status of the flotation system, the method further comprising the steps of:

evaluating the flotation system to determine whether said circuit status corresponds to conditions of underloading where the amount of said metal source passing through the system is below a predetermined minimum, conditions of overloading where the amount of said metal source passing through the system is above a predetermined maximum, or balanced conditions where the amount of said metal source passing through the system is between said predetermined minimum and said predetermined maximum, and controlling the froth flotation system by said rule-based expert system which adjusts performance of the froth flotation system in part on the basis of said circuit status.

5. The method of claim 4 wherein said expert system sacrifices metallurgical performance of at least one component of the system in order to increase economic performance of the mineral processing operation.

6. The method of claim 1 wherein the mineral processing operation includes a secondary metal recovery operation for recovering metal values from said tails metal portion, the method further comprising the steps of:

determining metal revenue data corresponding to metal revenues from recovered metal values associated with said secondary recovery operation, determining reagent data corresponding to reagent costs associated with said secondary recovery operation, and determining operating profit data corresponding to operating profit of the mineral processing operation as a function of said metal revenue data and said reagent data, wherein the rule-based expert system adjusts performance of the froth flotation system in part on the basis of said operating profit data.

7. The method of claim 1 wherein the mineral processing operation includes a secondary metal recovery operation for recovering metal values from said tails metal portion, the method further comprising the steps of:

determining data corresponding to costs associated with smelting and refining metal values in the flotation concentrate, determining data corresponding to costs associated with said secondary metal recovery operation, determining data corresponding to revenue from metal values in said flotation concentrate, and determining data corresponding to revenue from metal values in said tails, wherein the rule-based expert system adjusts performance of the froth flotation system in part on the basis of the foregoing data.

8. The method of claim 1 wherein said rule-based expert system employs a set of primary cause rules to select a parameter of the flotation operation to be adjusted and a set of secondary cause rules to evaluate whether there is margin for adjustment of said selected parameter.

9. The method of claim 8 wherein said expert system sacrifices metallurgical performance of at least one component of the system in order to increase economic performance of the mineral processing operation.

10. A method for controlling a froth flotation system in a mineral processing operation for recovering metal from a metal source, which froth flotation system produces flotation concentrate containing a concentrate metal portion of said metal from said metal source and tails containing a tails metal portion of said metal from said metal source, the method comprising the steps of:

evaluating the flotation system to determine whether said circuit status corresponds to conditions of underloading where the amount of said metal source passing through the system is below a predetermined minimum, conditions of overloading where the amount of said metal source passing through the system is above a predetermined maximum, or balanced conditions where the amount of said metal source passing through the system is if between said predetermined minimum and said predetermined maximum, and determining a target value for the amount of metal to be directed by the froth flotation system to the concentrate metal portion, determining a probability factor related to the probability of achieving said target value on the basis of historical knowledge of the froth flotation system and on the basis of said circuit status, and controlling the froth flotation system by a rule-based expert system which adjusts performance of the froth flotation system in part on the basis of said probability factor and in part on the basis of said circuit status, wherein said rule-based expert system employs a set of primary cause rules to select a parameter of the flotation operation to be adjusted and a set of secondary cause rules to evaluate whether there is margin for adjustment of said selected parameter.

11. The method of claim 10 wherein said expert system sacrifices metallurgical performance of at least one component of the system in order to increase economic performance of the mineral processing operation.

12. A method for controlling a froth flotation system in a mineral processing operation, which froth flotation system produces a flotation concentrate containing metal values and tails containing metal values, which system comprises treatment of said tails in a secondary metal recovery operation for recovery of metal values therefrom, the method comprising the steps of:

determining data corresponding to costs associated with smelting and refining metal values in the flotation concentrate, determining data corresponding to costs associated with said secondary metal recovery operation, determining data corresponding to revenue from metal values in said flotation concentrate, determining data corresponding to revenue from metal values in said tails, and controlling the froth flotation system by a rule-based expert system which adjusts performance of the froth flotation system in part on the basis of the foregoing data.

13. The method of claim 12 wherein said secondary metal recovery operation requires detoxification of effluent from said secondary metal recovery operation, the method further comprising the step of determining detoxification data corresponding to costs associated with said detoxification, and wherein the rule-based expert system adjusts performance of the froth flotation system in part on the basis of said detoxification data.

14. The method of claim 12 wherein said rule-based expert system employs a set of primary cause rules to select a parameter of the flotation operation to be adjusted and a set of secondary cause rules to evaluate whether there is margin for adjustment of said selected parameter.

15. A method for controlling a froth flotation system in a mineral processing operation, which froth flotation system produces a flotation concentrate containing metal values and tails containing metal values, which system comprises treatment of said tails in a secondary metal recovery operation for recovery of metal values therefrom, the method comprising the steps of:

determining metal revenue data corresponding to metal revenues from recovered metal values associated with said to secondary recovery operation, determining reagent data corresponding to reagent costs associated with said secondary recovery operation, determining operating profit data corresponding to operating profit of the mineral processing operation as a function of said metal revenue data and said reagent data, and controlling the froth flotation system by a rule-based expert system which adjusts performance of the froth flotation system in part on the basis of said operating profit data.

16. The method of claim 15 wherein said secondary metal recovery operation requires detoxification of effluent from said secondary metal recovery operation, the method further comprising determining detoxification reagent data corresponding to reagent costs associated with said detoxification, wherein the rule-based expert system adjusts performance of the froth flotation system in part on the basis of said detoxification reagent data.

17. A method for controlling a froth flotation system in a mineral processing operation, which froth flotation system produces a flotation concentrate containing metal values and tails containing metal values, which system comprises treatment of said tails in a secondary metal recovery operation for recovery of metal values therefrom, the method comprising:

determining data corresponding to costs associated with said secondary metal recovery operation, determining data corresponding to revenue from metal values in said tails, and controlling the froth flotation system by a rule-based expert system which adjusts performance of the froth flotation system in part on the basis of the foregoing data.

18. The method of claim 17 comprising the further steps of:

determining a target value for the amount of metal to be directed by the froth flotation system to the concentrate metal portion, and determining a probability factor related to the probability of achieving said target value on the basis of historical and diagnostic knowledge of the froth flotation system, wherein said rule-based expert system adjusts performance of the froth flotation system in part on the basis of said probability factor.

19. The method of claim 17 further comprising the steps of:

evaluating the flotation system to determine whether said circuit status corresponds to conditions of underloading where the amount of said metal source passing through the system is below a predetermined minimum, conditions of overloading where the amount of said metal source passing through the system is above a predetermined maximum, or balanced conditions where the amount of said metal source passing through the system is between said predetermined minimum and said predetermined maximum, wherein said rule-based expert system adjusts performance of the froth flotation system in part on the basis of said circuit status.

20. The method of claim 17 wherein said rule-based expert system employs a set of primary cause rules to select a parameter of the flotation operation to be adjusted and a set of secondary cause rules to evaluate whether there is margin for adjustment of said selected parameter.

21. The method of claim 17 wherein said secondary metal recovery operation requires detoxification of effluent from said secondary metal recovery operation, the method further comprising determining detoxification reagent data corresponding to reagent costs associated with said detoxification, wherein the rule-based expert system adjusts performance of the froth flotation system in part on the basis of said detoxification reagent data.

22. The method of claim 21 wherein the rule-based expert system adjusts performance of the froth flotation system in part on the basis of data which corresponds to a determination selected from the group consisting of a determination of costs associated with the froth flotation system, a determination of costs associated with smelting and refining metal values in the flotation concentrate, and a determination of revenue from metal values in said flotation concentrate.

23. The method of claim 17 wherein said secondary metal recovery operation involves cyanidation and detoxification of effluent from said cyanidation, the method comprising:

determining detoxification reagent data corresponding to reagent costs associated with said cyanidation, determining cyanidation reagent data corresponding to reagent costs associated with said detoxification, and controlling the froth flotation system by a rule-based expert system which adjusts performance of the froth flotation system in part on the basis of said cyanidation reagent data and in part on the basis of said detoxification reagent data.

24. A method for controlling a froth flotation system in a mineral processing operation, which froth flotation system produces a flotation concentrate containing metal values and tails containing metal values, which system comprises treatment of said tails in a secondary metal recovery operation for recovery of metal values therefrom and detoxification of effluent from said secondary metal recovery operation, the method comprising:

determining detoxification reagent data corresponding to reagent costs associated with said detoxification, and controlling the froth flotation system by a rule-based expert system which adjusts performance of the froth flotation system in part on the basis of said detoxification data.

25. The method of claim 24 comprising determining by chemical analysis on a real-time basis the amount of recoverable metal values in said tails and determining a function which relates said amount of recoverable metal values in said tails to associated detoxification costs, wherein the rule-based expert system adjusts performance of the froth flotation system in part on the basis of said function.

26. A method for controlling a froth flotation system in a mineral processing operation, which froth flotation system produces a flotation concentrate containing metal values and tails containing metal values, which system comprises treatment of said tails in a secondary metal recovery operation for recovery of additional metal values therefrom and a detoxification operation for detoxification of effluent from said secondary recovery operation, the method comprising:

determining a set of values to remain constant which relate to mineralogical characteristics of feed material to the froth flotation system, to leaching reagent consumption in said secondary recovery operation, and to detoxification reagent consumption in said detoxification operation, determining by chemical analysis on a real-time basis the amount of recoverable metal values in said tails, and controlling the froth flotation system by a rule-based expert system which adjusts performance of the froth flotation system in part on the basis of said constant values, in part on the basis of said chemical analysis, and in part on the basis of a determination of operating profit of the mineral processing operation as a function of metal revenues from recovered metal values associated with said secondary recovery operation and reagent costs associated with said secondary metal recovery operation.

27. The method of claim 26 comprising:

determining mineralogical characteristics of feed material to the froth flotation system and determining a mineralogical function which relates said mineralogical characteristics of said feed material to the amount of recoverable metal values in said tails, and controlling the froth flotation system by said rule-based expert system in part on the basis of said mineralogical function.

* * * * *